United States Patent [19]

Ushiro et al.

[11] 4,241,766

[45] Dec. 30, 1980

[54] SELECTIVE WEFT INSERTING APPARATUS IN SHUTTLELESS WEAVING LOOM

[75] Inventors: Masayuki Ushiro; Haruo Shimazaki, both of Tokyo, Japan

[73] Assignee: Nissan Motor Company, Limited, Japan

[21] Appl. No.: 4,058

[22] Filed: Jan. 16, 1979

[30] Foreign Application Priority Data

Jan. 17, 1978 [JP] Japan ..... 53-2649

[51] Int. Cl.[3] ..... D03D 47/38

[52] U.S. Cl. ..... 139/435; 139/453

[58] Field of Search ..... 139/453, 435, 450

[56] References Cited

U.S. PATENT DOCUMENTS

| | | | |
|---|---|---|---|
| 3,159,185 | 12/1964 | Smith | 139/453 |
| 3,323,556 | 6/1967 | Higgins et al. | 139/453 |
| 3,820,574 | 6/1974 | Mizuno | 139/453 |
| 4,074,728 | 2/1978 | Mizuno et al. | 139/435 |

*Primary Examiner*—Henry Jaudon

*Attorney, Agent, or Firm*—Lowe, King, Price & Becker

[57] ABSTRACT

An apparatus for selecting inserting weft yarns each into a weaving shed of warp yarns in a shuttleless weaving loom, in which a fluid distributor valve unit, a weft feeding and length-measuring mechanism and a weft retaining unit are operated by levers selectively driven for rocking motion depending upon the angular positions of cams mounted in two groups on separate cam shafts which are rotatable independently of each other and which are driven to turn about the respective center axes of the cam shafts in accordance with a predetermined weaving schedule stored in, for example, a dobby mechanism.

6 Claims, 11 Drawing Figures

SELECTIVE WEFT INSERTING APPARATUS IN SHUTTLELESS WEAVING LOOM

FIELD OF THE INVENTION

The present invention relates to a loom of the shuttleless type in which the pick of a weft yarn is inserted into a shed of warp yarns by a jet stream of fluid ejected into the shed during each cycle of operation of the loom. More particularly, the present invention relates to an apparatus for selectively inserting weft yarns of different natures each into the shed of warp yarns during each cycle of operation of the loom in accordance with a predetermined weaving schedule.

DESCRIPTION OF THE PRIOR ART

A known apparatus for selectively inserting weft yarns into a weaving shed of warp yarns in a shuttleless loom uses a cam constantly rotating at a speed related to the cycles of operation of the loom and a mechanical linkage to be driven in accordance with a predetermined weaving schedule for transmitting the motions of the cam to weft inserting means for selecting and actuating one of the functional elements included in the weft inserting means. While offering usefulness of a considerable degree, such an apparatus is not fully acceptable because of the complexity of construction especially where the apparatus is to be designed to be capable of dealing with three or more weft yarns.

SUMMARY OF THE INVENTION

In accordance with the present invention, there is provided to eliminate such a drawback an apparatus comprising weft inserting means operative to insert a selected one of the weft yarns into the shed of warp yarns when actuated, conditioning means for producing conditions in which a selected weft yarn is to be inserted into the shed, at least two cam shafts axially aligned with each other and rotatable independently of each other in both directions about the respective center axes of the shafts in accordance with a predetermined weaving schedule, cams rotatable with and arranged axially of each of the cam shafts, levers rockable about an axis of rotation substantially parallel with the center axes of the cam shafts and each engageable with at least one of the cams on the cam shafts, the levers being driven to rock about the axis of rotation selectively depending upon the respective rotational positions of the cam shafts about the center axes of the cam shafts, and mechanical linkage means operatively intervening between the levers and the conditioning means for enabling the conditioning means to produce the conditions depending upon the angular position of at least one of the levers about the axis of rotation.

The above mentioned conditioning means may include a weft feeding and length-measuring mechanism, a fluid distributor valve unit and/or a weft retaining mechanism which may be incorporated into an apparatus according to the present invention as will be described hereinafter.

DESCRIPTION OF THE DRAWINGS

The features and advantages of an apparatus according to the present invention will be appreciated more clearly from the following description taken in conjunction with the accompanying drawings, in which.

DETAILED DESCRIPTION OF THE PREFERRED EMBODIMENT

Figure 1:
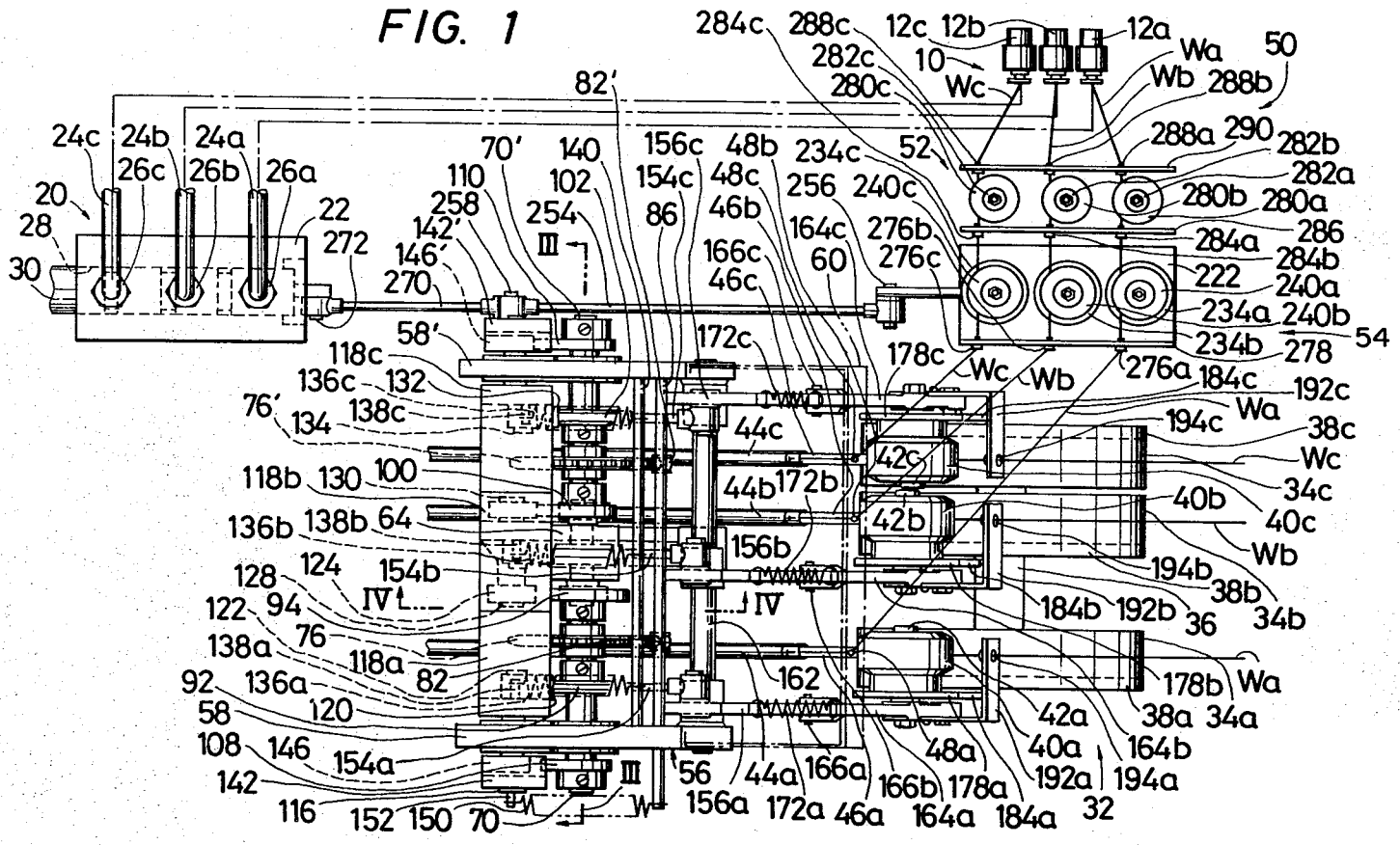
FIG. 1 is a top plan view showing, in part schematically, a preferred embodiment of an apparatus according to the present invention.

The construction and the principal modes of operation of the apparatus embodying the present invention will be hereinafter described in detail with reference to the accompanying drawings. The embodiment shown in the drawings is assumed, by way of example, to be in-incorporated into an automatic weaving loom of a shuttleless or fluidjet weft inserting type using three weft yarns of different natures such as, for example, colors. As the description proceeds, however, it will be understood that an apparatus according to the present invention is applicable to a shuttleless loom using two or more than three weft yarns of different natures. In the drawings herewith presented, furthermore, some of the important members, units and structures which are known per se of an automatic weaving loom are not shown for the sake of clarity of illustration. The constructions and functions of such members, units and structures are, however, well known to those familiar with the art of textile production, while the positions and motions of these members, unit and structure in conjunction with the elements included in the arrangement to be hereinafter described with reference to the drawings will be readily understood or known from the description regarding the latter.

As is well known in the art, a weaving loom of a shuttleless type has a weaving stage at which a number of warp yarns forwardly leading to a fabric previously woven are respectively passed through the eyes in healds supported in groups by a suitable number of heald frames which are selectively raised or lowered at the rear of the fell of the woven fabric so that the warp yarns are grouped into two webs forming therebetween a weaving shed parallel with the fell of the woven fabric during each cycle of operation of the loom. A pick of a selected weft yarn which has been fed to a predetermined length is shot through this weaving shed by means of a jet stream of fluid shot into the shed and is thereafter beaten up onto the fell of the woven fabric. To have a pick of a selected inserted into the weaving shed, the shuttleless loom partly illustrated in the drawings (FIG. 1) includes a weft inserting unit 10 comprising three weft shooting nozzles which consist of first, second and third weft shooting nozzles 12*a*, 12*b* and 12*c* which are positioned in the vicinity of one lateral end of the weaving shed to be formed during each cycle of operation of the loom as above discussed. Each of the weft shooting nozzles 12*a*, 12*b* and 12*c* is movable into and out of a position aligned with the weaving shed and ready to inject a jet stream of fluid into the shed in a direction parallel with the fell of a previously woven fabric (not shown). During operation of the loom, the weft shooting nozzles 12*a*, 12*b* and 12*c* are selectively moved into such a position by nozzle actuating means (not shown) operating under the control of a suitable control device such as a dobby head 14 schematically shown in FIG. 2. The dobby head 14 has included therein a pattern card mechanism 16 comprising a plurality of chain and sprocket arrangements having pegs 18 releasably fitted to each of the endless chains. The pegs 18 on the individual chains are arranged to provide a desired weaving pattern of a fabric and are engageable with the nozzle actuating means for the weft shooting nozzles 12*a*, 12*b* and 12*c* through a suitable mechanical linkage (not shown) so that the weft shooting nozzles 12*a*, 12*b* and 12*c* are selectively moved into the position aligned with the weaving shed in accordance with the arrangement of the pegs 18 on the chains. The pegs 18 are also engageable with the heald frames of the loom so that the warp yarns to be interwoven with a weft yarn during each cycle of operation of the loom are selectively raised and lowered also under the control of the dobby mechanism 14.

Fluid under pressure supplied from a power-driven pump (not shown) is distributed selectively to the weft shooting nozzles 12*a*, 12*b* and 12*c* through a fluid distributor valve unit 20 including a stationary valve body 22 to which fluid feed conduits 24*a*, 24*b* and 24*c* connected each at one end to the nozzles 12*a*, 12*b* and 12*c*, respectively, are fitted at the other ends thereof by means of suitable fittings such as fittings 26*a*, 26*b* and 26*c*, respectively, as shown. The valve body 22 is formed with an axial bore 28 through which a valve spool 30 is slidable. As will be described in more detail, the valve spool 30 is movable between three axial positions in each of which the fluid under pressure supplied to the valve unit 20 from the power-driven pump is passed to one of the fluid feed conduits 24*a*, 24*b* and 24*c* and prevented from being directed to the remaining two of the conduits.

The shuttleless looms illustrated in the drawings further includes a weft feeding and length-measuring mechanism 32 comprising first, second and third length measuring rollers 34*a*, 34*b* and 34*c* mounted on a common drive shaft 36 for being driven for rotation with the shaft 36 in the direction of arrow a about the center axis of the shaft. As will be better seen from FIG. 2, each of the length measuring rollers 34*a*, 34*b* and 34*c* has an annular flange 38*a*, 38*b* and 38*c* axially projecting from one end face of the roller along the entire circumference thereof. The length measuring rollers 34*a*, 34*b* and 34*c* have substantially equal diameters selected depending upon the length of the pick of a weft yarn to be inserted into the weaving shed or, in other words, upon the width of a fabric to be woven and may be releasably mounted on the drive shaft 36 so as to be interchangeable with rollers with diameters adapted to produce fabrics with other widths. The drive shaft 36 supporting these length measuring rollers 34*a*, 34*b* and 34*c* is driven to make a full turn about the center axis thereof during each cycle of operation of the loom.

Figure 2:
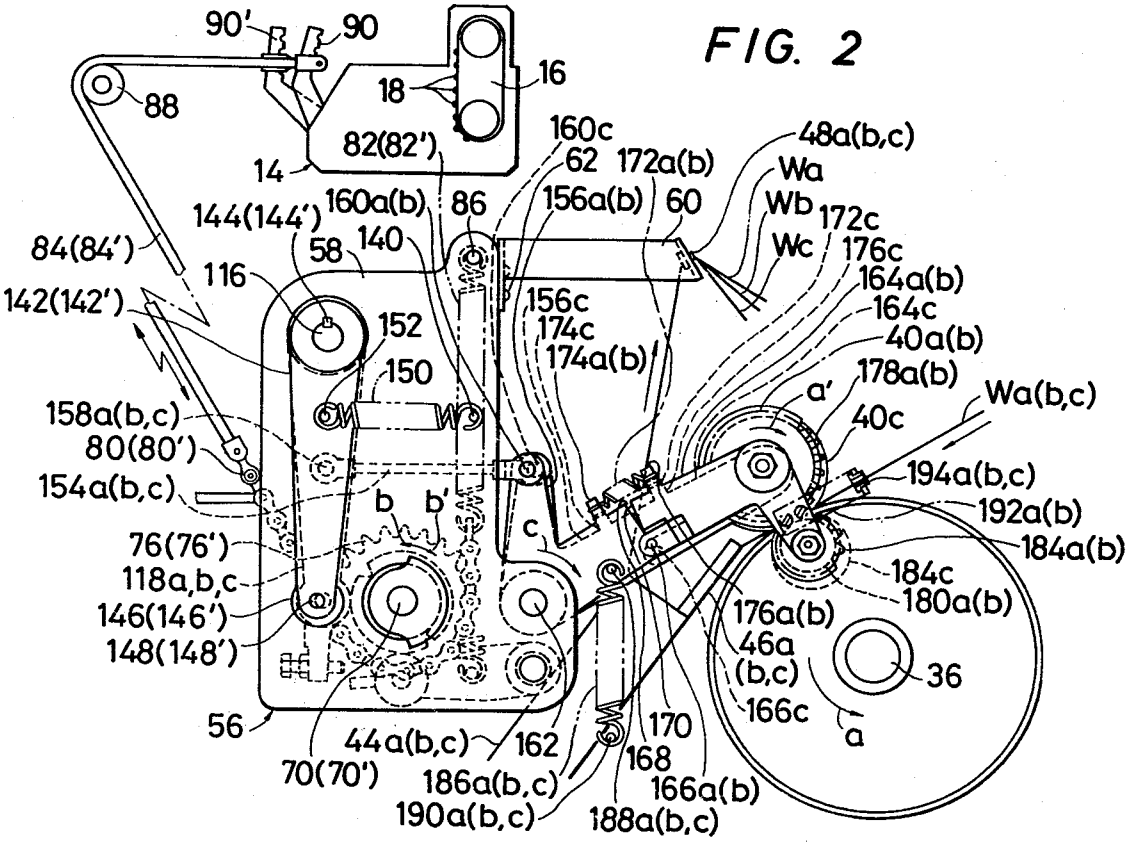
FIG. 2 is a side elevational view of the apparatus illustrated in FIG. 1, some of the members and units shown in FIG. 1 being omitted from FIG. 2 for simplicity of illustration.

The weft feeding and length-measuring mechanism 32 illustrated in FIGS. 1 and 2 further comprises first, second and third pressing rollers 40*a*, 40*b* and 40*c* provided in association with the above described length measuring rollers 34*a*, 34*b* and 34*c*, respectively, and rotatable on shafts 42*a*, 42*b* and 42*c*, respectively, which are arranged in parallel with the drive shaft 36. As will be described in more detail, the shafts 42*a*, 42*b* and 42*c* supporting the pressing rollers 40*a*, 40*b* and 40*c*, respectively, are movable independently of one another toward and away from the center axis of the drive shaft 36 so that each of the pressing rollers 40*a*, 40*b* and 40*c* is movable into and out of a position rollable on the outer peripheral surface of the associated one of the length measuring rollers 34*a*, 34*b* and 34*c*. The weft yarns W*a*, W*b* and W*c* supplied from suitable sources (not shown) such as cones or cheeses are passed between the respectively associated length measuring and pressing rollers 34*a* and 40*a*, 34*b* and 40*b*, and 34*c* and 40*c*, as will be better seen from FIG. 2. When any of the pressing rollers 40*a*, 40*b* and 40*c* is in rolling contact with the associated one of the length measuring rollers 34*a*, 34*b* and 34*c* being driven by the drive shaft 36, the pressing roller is driven by the particular length measuring roller for rotation in the direction of arrow a' about the center axis of the shaft 42*a*, 42*b* and 42*c* so that the weft yarn W*a*, W*b* and W*c* passed between the pressing and length measuring rollers is pressed therebetween and is fed a predetermined length past the rollers each time the drive shaft 36 makes a full turn about the center axis thereof. The weft yarns W*a*, W*b* and W*c* thus drawn through the weft feeding and length-measuring mechanism 32 are temporarily stored or detained in weft detaining tubes 44*a*, 44*b* and 44*c*, respectively, which are positioned behind the first, second and third length measuring and pressing rollers 34*a* and 40*a*, 34*b* and 40*b*, and 34*c* and 40*c*, respectively. The weft detaining tubes 44*a*, 44*b* and 44*c* have tubular projections 46*a*, 46*b* and 46*c*, respectively, each of which projects from one end of the tube and is open adjacent the area along which the pressing and length measuring rollers associated with the tube are to be in contact with each other as will be better seen from FIG. 2. The weft yarns W*a*, W*b* and W*c* passed through the respectively associated length measuring and pressing rollers 34*a* and 40*a*, 34*b* and 40*b* and 34*c* and 40*c* are admitted into the weft detaining tubes 44*a*, 44*b* and 44*c* through these tubular projections 46*a*, 46*b* and 46*c*, resepectively. Each of the weft detaining tubes 44*a*, 44*b* and 44*c* is at least in part open at its end adjacent the tubular projection 46*a*, 46*b* or 46*c* and provides an outlet for the weft yarn admitted into the tube. The weft detaining tubes 44*a*, 44*b* and 44*c* communicate at the other ends thereof with a suitable source (not shown) of vacuum so that each of the weft yarns W*a*, W*b* and W*c* admitted into the tubes 44*a*. 44*b* and 44*c* through the tubular projections 46*a*, 46*b* and 46*c*, respectively, and in part leading from each tube through the open outlet end of the tube is detained in a hair-pin curved form within the tube by the suction established in each of the tubes during or throughout operation of the loom. The weft yarns W*a*, W*b* and W*c* leading from the respective open outlet ends of the weft detaining tubes 44*a*, 44*b* and 44*c* thus arranged are passed through stationary guide elements 48*a*, 48*b* and 48*c*, respectively, to a weft retaining assembly 50 positioned in the vicinity of the weft inserting unit 10 as shown in FIG. 2. As will be described in detail, the weft retaining assembly 50 largely consists of a main weft retaining unit 52 and an auxiliary weft retaining unit 54 and is operative to temporarily retain thereto the weft yarns W*a*, W*b* and W*c* to be passed to the weft inserting unit 10 and to allow a selected one of the weft yarns to be passed to a selected one of the weft shooting nozzles 12*a*, 12*b* and 12*c* of the weft inserting unit 10 during each cycle of operation of the loom.

The apparatus embodying the present invention is adapted to control the motions of the fluid distributor unit 20 and the weft retaining assembly 50 of the automatic shuttleless loom thus constructed and arranged and comprises a stationary frame structure 56 including a pair of side plates 58 and 58' which are spaced in parallel from each other as shown in FIGS. 1 and 2. The above mentioned guide elements 48*a*, 48*b* and 48*c* for the weft yarns W*a*, W*b* and W*c*, respectively, are fixedly mounted on a bracket 60 fastened to the side plates 58 and 58' of the frame structure 56 by means of bolts 62 (FIG. 2).

The frame structure 56 has further fixedly mounted thereon a bearing block 64 which is spaced apart substantially equidistantly from the respective inner faces of the side plates 58 and 58' of the frame structure as seen in FIG. 1. As illustrated to an enlarged scale in FIGS. 3A, 3B and 3C, the side plates 58 and 58' and the bearing block 64 are formed with axial bores 66, 66' and 68, respectively, which have respective center axes substantially aligned with each other and each of which is open at both ends thereof. A cam shaft 70 has one end portion journaled in the axial bore 66 in one side plate 58 of the frame structure 56 by means of a bushing 72 and the other end portion journaled in one axial half of the bore 68 in the bearing block 64 by means of a bushing 74. Likewise, a cam shaft 70' has one end portion journaled in the axial bore 66' in the other side plate 58' of the frame structure 56 by means of a bushing 72' and the other end portion journaled in the other axial half of the bore 68 in the bearing block 64 by means of the bushing 74. The shafts 70 and 70' thus supported on the side plates 58 and 58' and the bearing block 64 of the frame structure 56 are rotatable independently of each other about axes substantially aligned with each other.

Figure 3A:
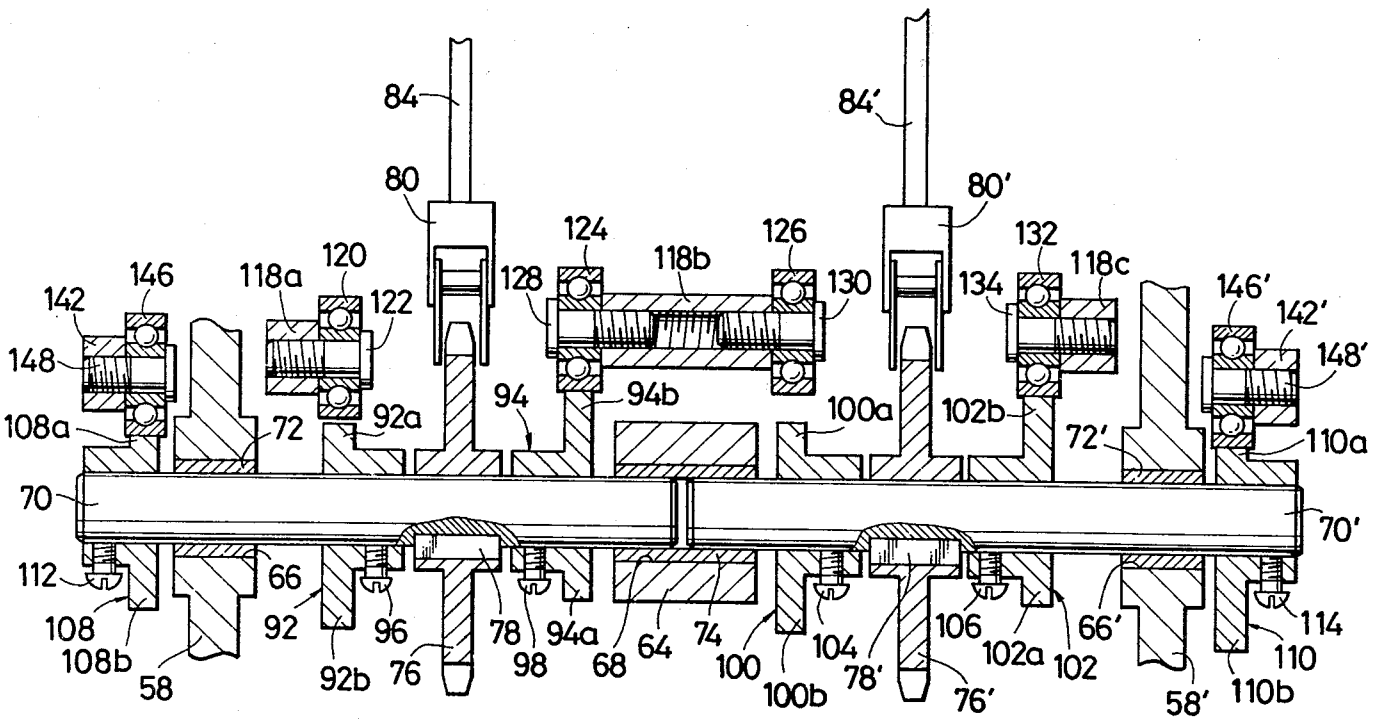
FIGS. 3A, 3B and 3C are sectional views taken along line III—III of FIG. 1 and showing different operational conditions of the cam arrangement forming part of the embodiment illustrated in FIGS. 1 and 2.
Figure 3B:
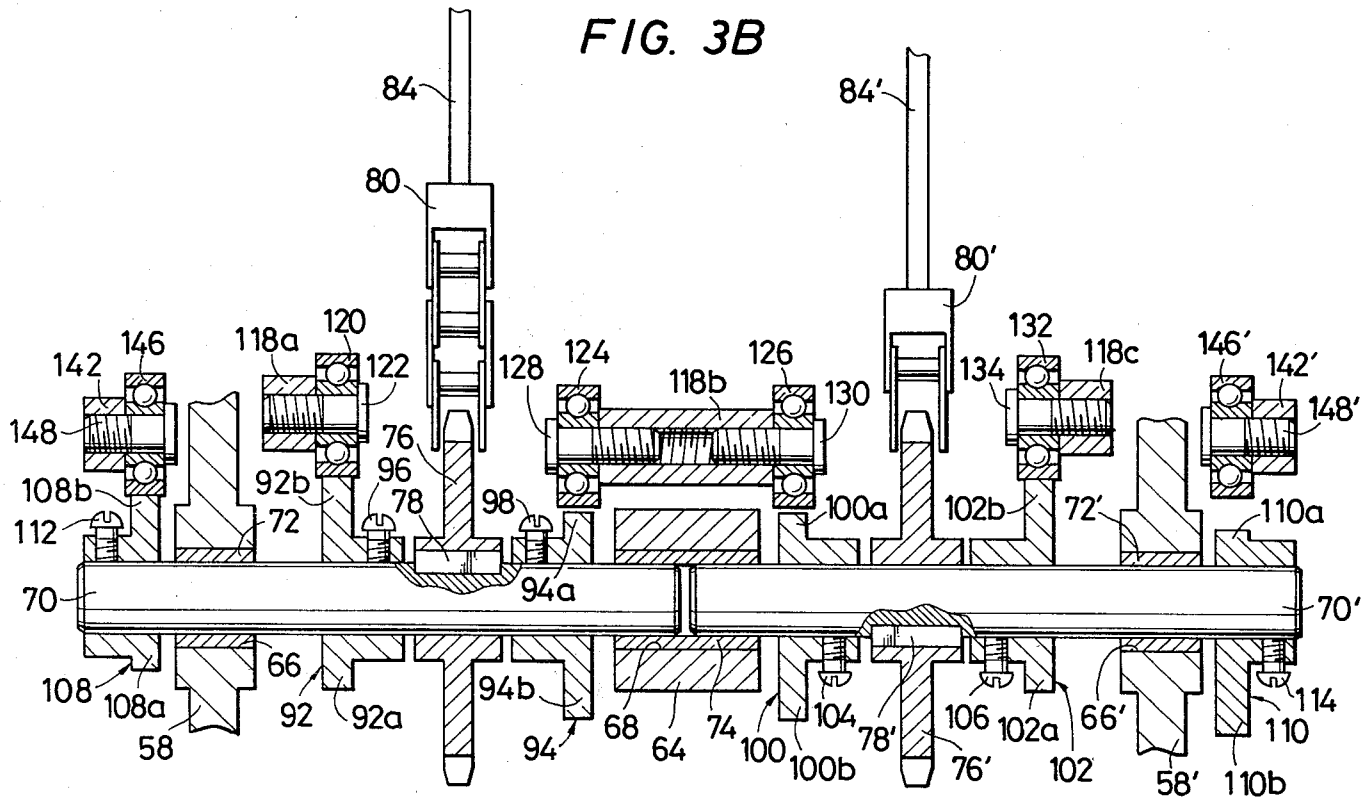
Figure 3C:
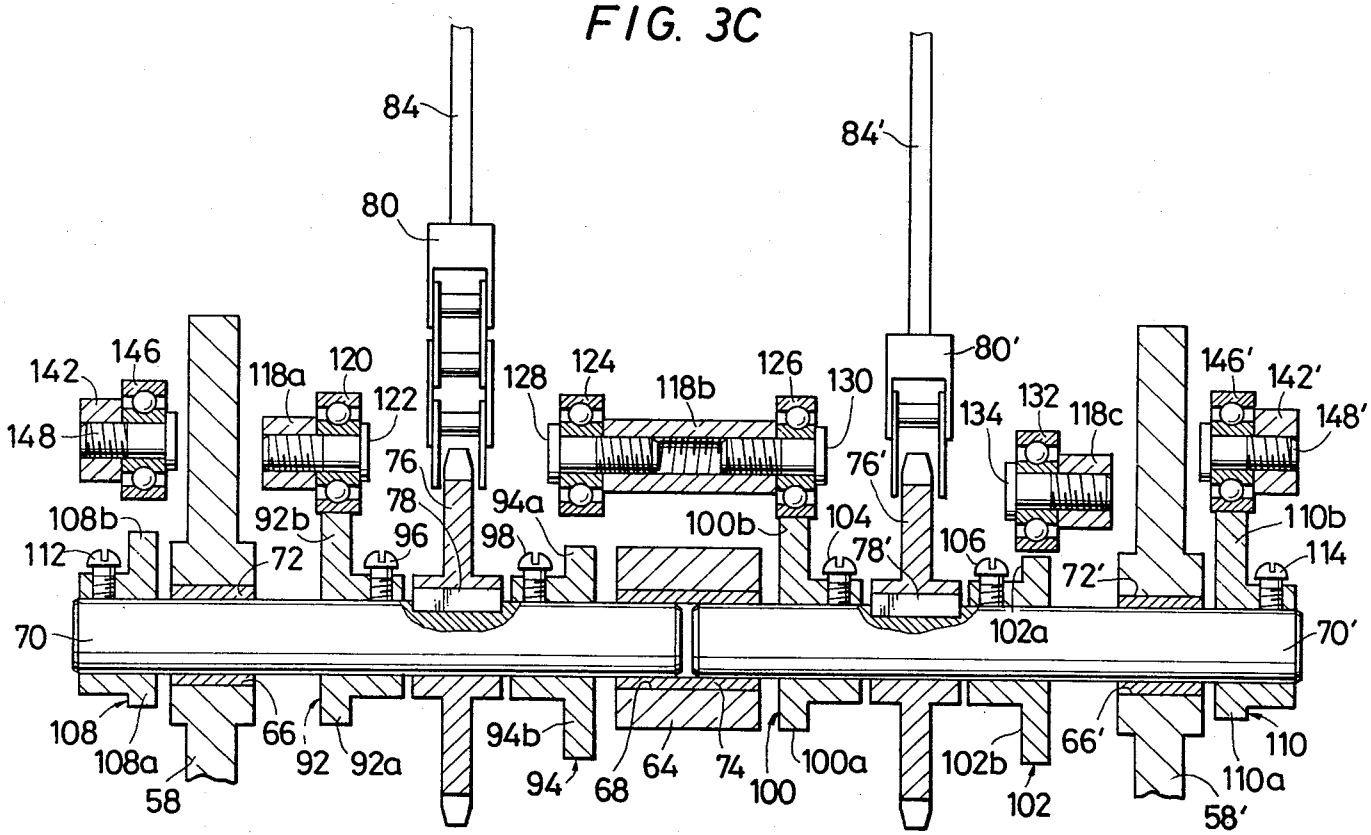

The cam shafts 70 and 70' have mounted thereon sprocket wheels 76 and 76', respectively, which are keyed to intermediate axial portions of the shafts 70 and 70' as indicated at 78 and 78' in FIGS. 3A, 3B and 3C and which are engaged by roller chains 80 and 80', respectively, as will be better seen from FIG. 2. The chains 80 and 80' are connected each at one end to preloaded helical tension springs 82 and 82', respectively, and at the other ends thereof to ropes 84 and 84', respectively, as shown in FIG. 2 and in part in FIG. 1. The tension springs 82 and 82' thus connected each at one end to the roller chains 80 and 80', respectively, are anchored at the other ends thereof to a spring retaining bar 86 which is secured at both ends to the side plates 58 and 58' of the frame structure 56 as shown in FIG. 1. Each of the sprocket wheels 76 and 76' and accordingly each of the cam shafts 70 and 70' supporting the sprocket wheels are urged to turn counter clockwise in FIG. 2, viz., in the direction of arrow b about the center axis of the cam shaft. The ropes 84 secured each at one end to the roller chains 80 and 80' are passed through a guide roller 88 and anchored at the other ends thereof to first and second levers 90 and 90' forming part of the previously described dobby head 14 shown in FIG. 2. The levers 90 and 90' of the dobby head 14 are angularly movable independently of each other each between a first angular position allowing the associated one of the ropes 84 and 84' to be pulled by the tension spring 82 or 82' as is the case with the second lever 90' shown in FIG. 2 and a second angular position pulling the associated rope 84 or 84' against the force of the spring 82 or 82' as is the case with the first lever 90 shown in FIG. 2. When each of the levers 90 and 90' of the dobby head 14 is in the first and second angular positions thereof, each of the cam shafts 70 and 70' supporting the sprocket wheels 76 and 76' thus engaged by the ropes 84 and 84' assumes predetermined first and second rotational positions, respectively, about the center axis thereof as will be described in more detail. The levers 90 and 90' are moved between the respective first and second angular positions thereof depending upon the positions of the pegs 18 on the chains of the pattern card mechanism 18 included in the dobby head 14.

The cam shafts 70 and 70' have further supported thereon cams including first and second inner cams 92 and 94 securely mounted on one cam shaft 70 by set screws 96 and 98, respectively, and third and fourth inner cams 100 and 102 securely mounted on the other cam shaft 70' by set screws 104 and 106, respectively, as shown in FIGS. 3A, 3B and 3C. The first and second inner cams 92 and 94 mounted on the cam shaft 70 are positioned on both sides of the sprocket wheel 76 on the cam shaft 70 and, likewise, the third and fourth inner cams 100 and 102 mounted on the cam shaft 70' are positioned on both sides of the sprocket wheel 76' on the cam shaft 70. The cams 92, 94, 100 and 102 have substantially congruent external contours each having a generally semicircular small-diameter cam lobe portion indicated by subscript a affixed to each of the reference numerals for the cams and a generally semicircular large-diameter cam lobe portion indicated by subscript b affixed to each of the reference numerals for the cams, as will be seen more clearly from FIGS. 4A, 4B and 5 in which the second and third inner cams 94 and 100 are shown. The first and third inner cams 92 and 100 are 180 degrees out of phase with the second and fourth inner cams 94 and 102, respectively, about the aligned center axes of the cam shafts 70 and 70'. Thus, the small-diameter and large-diameter cam lobe portions 92*a* and 92*b* of the first inner cam 92 are in diameterically opposite relationship to the small-diameter and large-diameter cam lobe portions 94*a* and 94*b*, respectively, of the second inner cam 94 and, likewise, the small-diameter and large-diameter cam lobe portions 100*a* and 100*b* of the third inner cam 100 are in diameterically opposite relationship to the small-diameter and large diameter cam lobe portions 102*a* and 102*b*, respectively, of the fourth inner cam 102.

The cam shafts 70 and 70' have respective outer end portions projecting outwardly from the side plates 58 and 58', respectively, of the frame structure 56 and have first and second outer cams 108 and 110 fixedly mounted on these outer end portions by means of set screws 112 and 114, respectively. The first outer cam 108 has generally semicircular small-diameter and large-diameter cam lobe portions 108*a* and 108*b* which are angularly in phase with the small-diameter and large-diameter cam lobe portions 92*a* and 92*b*, respectively, of the first inner cam 92 and, likewise, the second outer cam 110 has generally semicircular small-diameter and large-diameter cam lobe portions 110*a* and 110*b* which are angularly in phase with the small-diameter and large-diameter cam lobe portions 100*a* and 100*b*, respectively, of the third inner cam 100. The small-diameter cam lobe portion 110*a* of the second outer cam 110 is equal in diameter to the small-diameter cam lobe portion 108*a* of the first outer cam 108 but the large-diameter cam lobe portion 110*b* of the first outer cam 110 is larger in diameter than the large-diameter cam lobe portion 108*b* of the second outer cam 108, as will be seen from FIGS. 3A, 3B and 3C.

On the frame structure 56 is further supported a shaft 116 which is journaled at both ends on the side plates 58 and 58' of the frame structure 56 and which extends in parallel with the cam shafts 70 and 70' as will be seen from FIGS. 1 and 2. The shaft 116 has mounted thereon first, second and third inner levers 118*a*, 118*b* and 118*c* which have respective hub portions circumferentially slidable on the shaft 116 and which are rotatable independently of one another about the center axis of the shaft 116. The first inner lever 118*a* has a leading end portion movable in the neighbourhood of the first inner cam 92 on the cam shaft 70 and has a cam follower roller 120 rotatable on a pin 122 screwed to the leading end portion of the lever 118*a* as shown in FIGS. 3A, 3B and 3C. On the other hand, the second inner lever 118*b* has a leading end portion elongated in parallel with the cam shafts 70 and 70' and movable in the neighbourhood of the second and third inner cams 94 and 100 on the cam shafts 70 and 70', respectively, and has cam follower rollers 124 and 126 rotatable independently of each other on pins 128 and 130 screwed to the leading end portion of the lever 118*b*, as shown in FIGS. 3A, 3B and 3C and in part in FIGS. 4 and 5. The third inner lever 118*c* has a leading end portion movable in the neighbourhood of the fourth inner cam 102 on the cam shaft 70' and has a cam follower roller 132 rotatable on a pin 134 screwed to the leading end portion of the lever 118*c* as shown in FIGS. 3A, 3B and 3C. The pins 122, 128, 130 and 134 thus supporting the cam follower rollers 120, 124, 126 and 132, respectively, on the levers 118*a*, 118*b* and 118*c* have respective center axes substantially parallel with the center axes of the cam shafts 70 and 70' so that the cam follower rollers 120, 124, 126 and 132 are engageable with the first, second, third and fourth inner cams 92, 94, 100 and 102, respectively, depending upon the rotational positions of the cam shafts 70 and 70' about the center axes thereof and the angular positions of the levers 118*a*, 118*b* and 118*c* about the center axis of the shaft 116 supporting the levers. The levers 118*a*, 118*b* and 118*c* are urged to turn about the center axis of the shaft 116 in directions causing the cam follower rollers 120, 124, 126 and 132 to contact the cams 92, 94, 100 and 102, respectively, by suitable biasing means such as preloaded helical tension springs 136*a*, 136*b* and 136*c* which are anchored each at one end to pins 138*a*, 138*b* and 138*c* secured to the levers 118*a*, 118*b* and 118*c*, respectively, and at the other ends thereof to a spring retaining bar 140 extending between the side plates 58 and 58' of the frame structure 56 as shown in FIG. 1.

The previously mentioned first and second rotational positions of the cam shaft 70 supporting the first and second inner cams 92 and 94 thereon are such that the first and second inner cams 92 and 94 have their respective small-diameter and large-diameter cam lobe portions 92*a* and 94*b* turned into angular positions engageable with the respectively associated cam follower rollers 120 and 124 when the cam shaft 70 is in the first rotational position thereof and, when the cam shaft 70 is in the second rotational position thereof, the cams 92 and 94 have their respective large-diameter and small-diameter cam lobe portions 92*b* and 94*a* turned into angular positions engageable with the cam follower rollers 120 and 124, respectively. Similarly, the first and second rotational positions of the cam shaft 70' supporting the third and fourth inner cams 100 and 102 are such that the third and fourth inner cams 100 and 102 have their respective large-diameter and small-diameter cam lobe portions 100*b* and 102*a* turned into angular positions engageable with the respectively associated cam follower rollers 126 and 132 when the cam shaft 70' is in the first rotational position thereof and, when the cam shaft 70' is in the second rotational position thereof, the cams 100 and 102 have their respective small-diameter and large-diameter cam lobe portions 100*a* and 102*b* turned into angular positions engageable with the cam follower rollers 126 and 132, respectively.

Figure 6A:
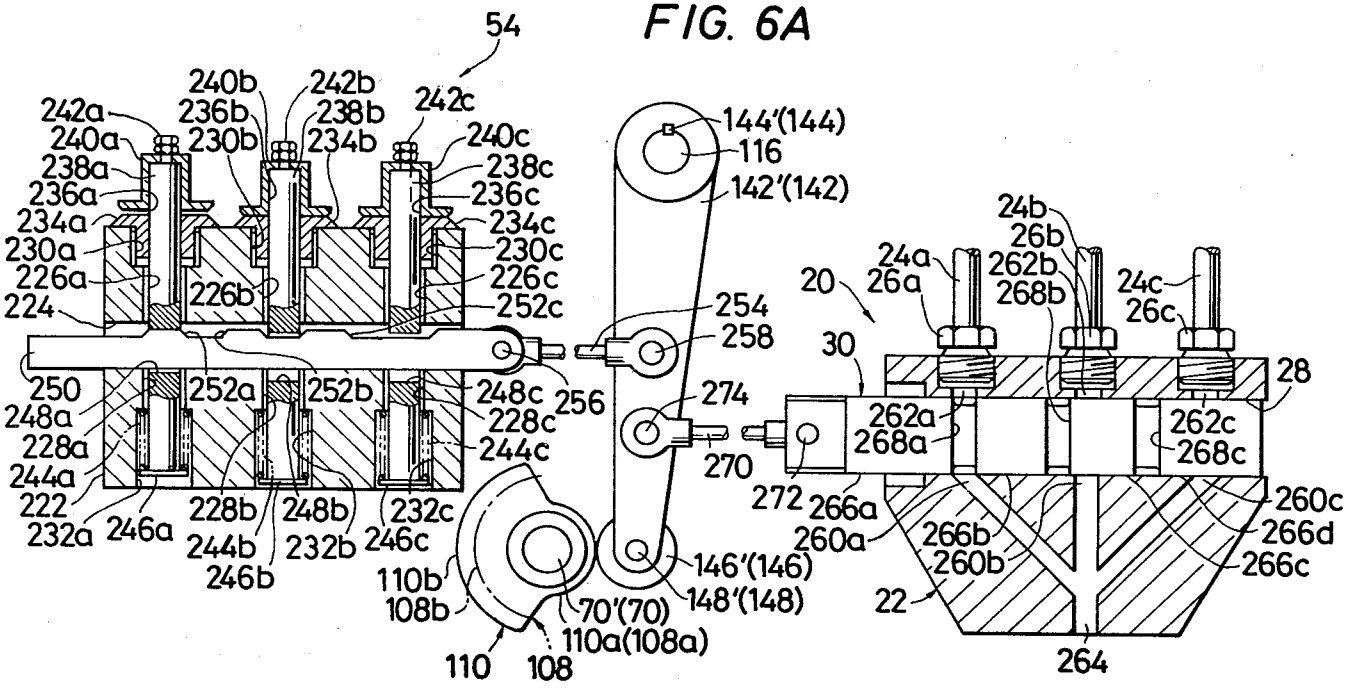
FIGS. 6A, 6B and 6C are sectional views showing, to an enlarged scale and in part in side elevation, different operational conditions of the fluid distributor valve unit and the auxiliary weft retaining unit forming part of the embodiment illustrated in FIGS. 1 and 2.
Figure 6B:
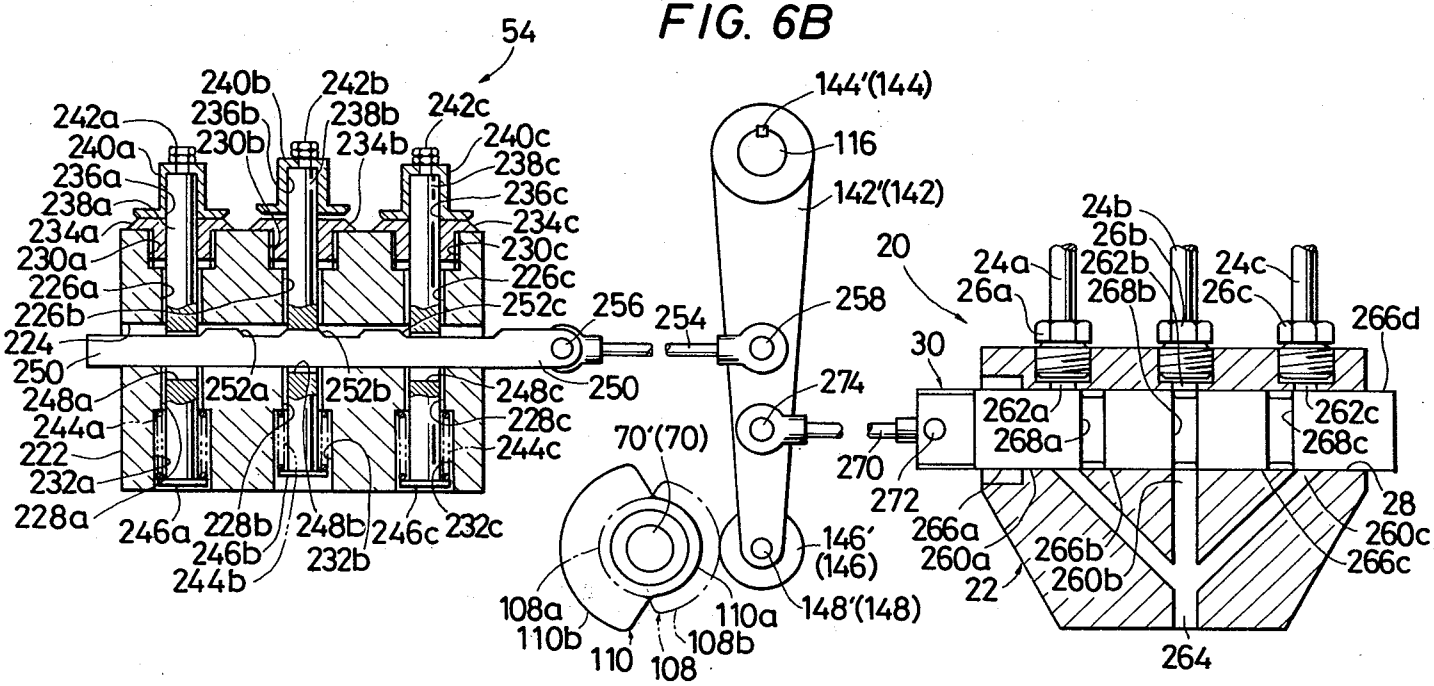
Figure 6C:
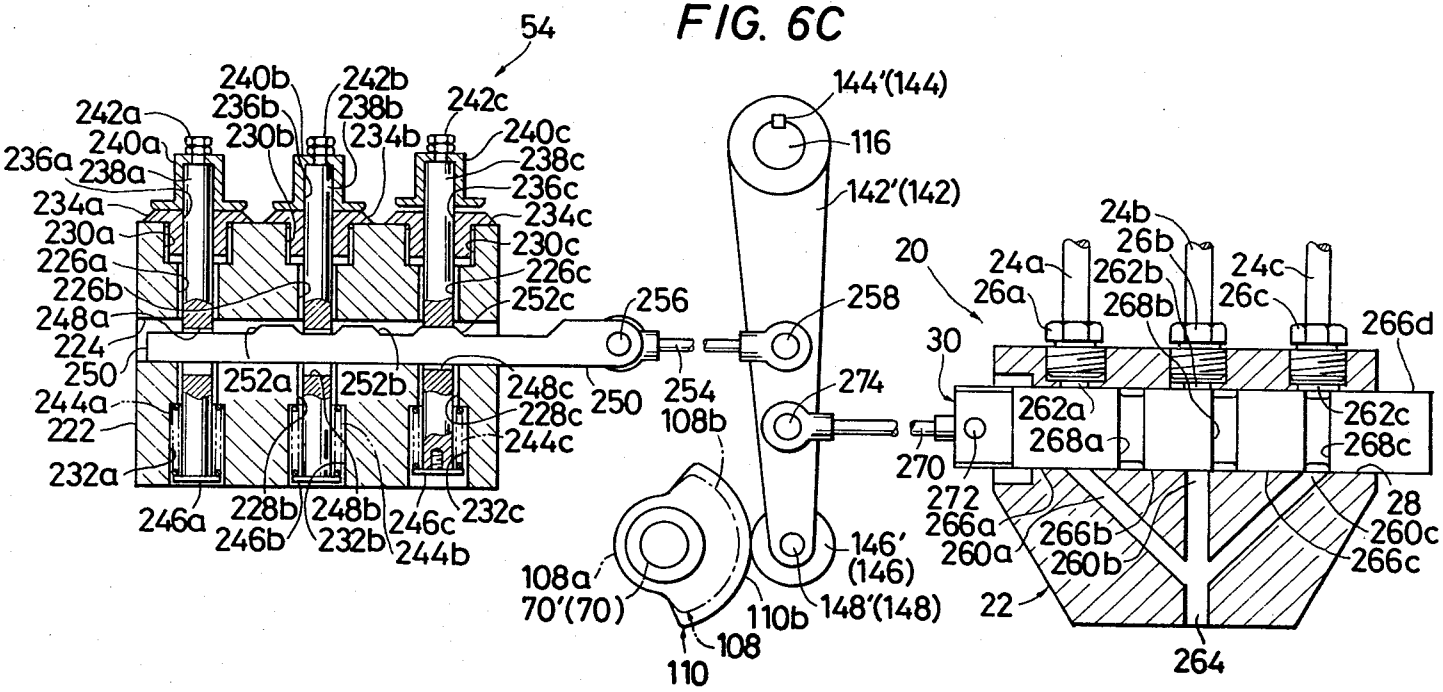

The shaft 116 supporting the levers 138*a*, 138*b* and 138*c* has further supported thereon first and second outer levers 142 and 142' which have respective hub portions keyed as at 144 and 144' to the shaft 116 as illustrated in FIGS. 1 and 2 and more clearly in FIGS. 6A, 6B and 6C showing the second outer lever 144' and which are mounted on the shaft 116 in such a manner as to be angularly in phase with each other about the center axis of the shaft 116. The levers 142 and 142' have respective leading end portions movable in the neighbourhood of the first and second outer cams 108 and 110, respectively, on the cam shafts 70 and 70' and have cam follower rollers 146 and 146', respectively, mounted on pins 148 and 148' screwed to the leading end portions of the levers 142 and 142', respectively. The pins 148 and 148' have respective center axes substantially parallel with the center axes of the cam shafts 70 and 70', respectively, so that the cam follower rollers 146 and 146' supported thereon are engageable with the first and second outer cams 108 and 110, respectively, depending upon the rotational positions of the cam shafts 70 and 70' about the center axes thereof and the angular positions of the levers 142 and 142' about the center axis of the shaft 116. The first outer cam 108 on the cam shaft 70 has its small-diameter cam lobe portion 108*a* turned into an angular position engageable with the associated cam follower roller 146 when the cam shaft 70 is in the first rotational position thereof and, when the cam shaft 70 is in the second rotational position thereof, the cam 108 has its large-diameter cam lobe portion 108*b* turned into an angular position engageable with the cam follower roller 146. On the other hand, the second outer cam 110 on the cam shaft 70' has its large-diameter cam lobe portion 110*b* turned into an angular position engageable with the associated cam follower roller 146' when the cam shaft 70' is in the first rotational position thereof and, when the cam shaft 70' is in the second rotational position thereof, the cam 110 has its small-diameter cam lobe portion 110*a* turned into an angular position engageable with the cam follower roller 146'. The levers 142 and 142' supporting the cam follower rollers 146 and 146' are urged to turn about the center axis of the shaft 116 in directions causing the cam follower rollers 146 and 146' to contact the cams 108 and 110, respectively, by suitable biasing means such as a preloaded helical tension spring 150 which is anchored at one end to a pin 152 secured to the lever 142 and at the other end to the previously mentioned spring retaining bar 140 mounted on the side plates 58 and 58' of the frame structure 56, as shown in FIGS. 1 and 2.

Figure 4A:
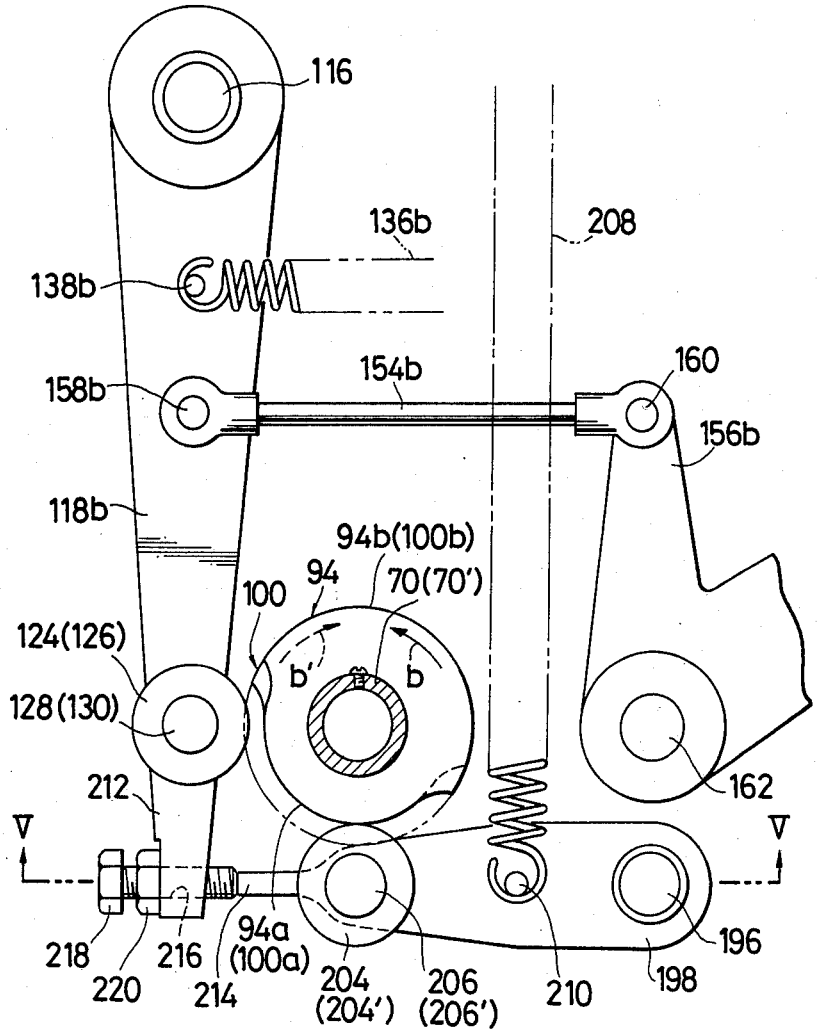
FIGS. 4A and 4B are views showing some parts of the embodiment of FIGS. 1 and 2 as viewed from a plane indicated by lines IV—IV in FIG. 1.
Figure 4B:
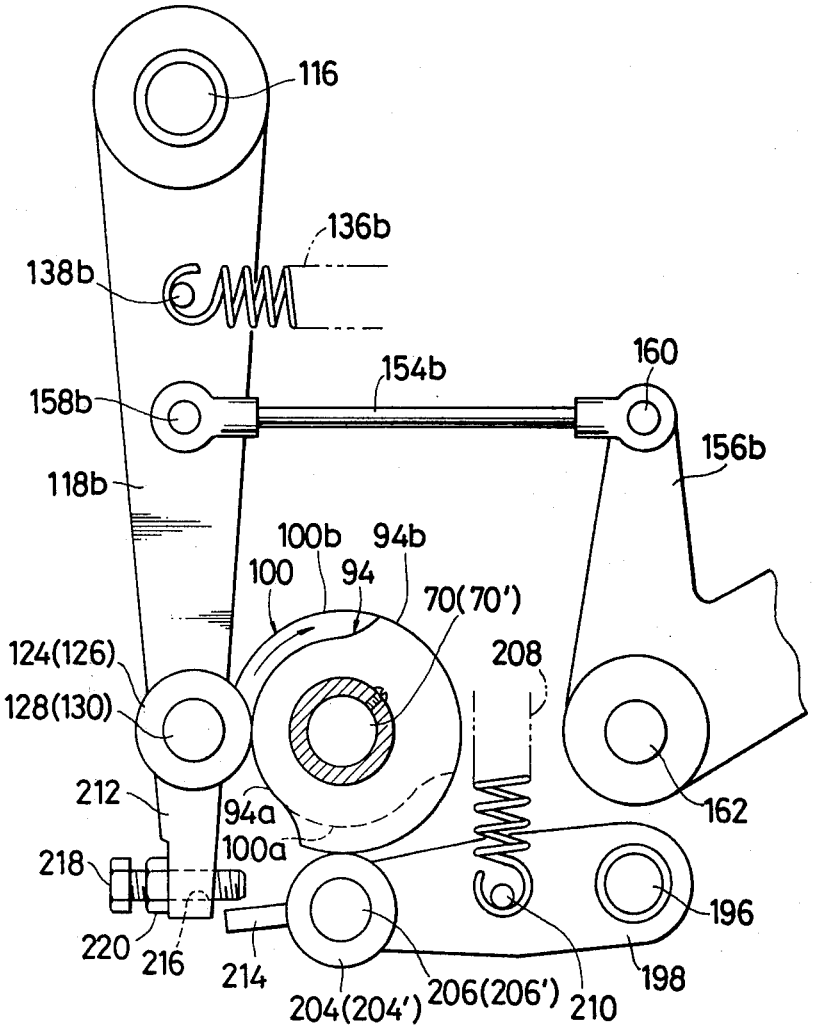

The levers 118*a*, 118*b* and 118*c* are linked by connecting rods 154*a*, 154*b* and 154*c* to first, second and third bell crank levers 156*a*, 156*b* and 156*c*, respectively, each having an intermediate fulcrum portion and two arm portions angularly spaced apart from each other about the fulcrum portion as shown in FIGS. 1 and 2 and further in FIGS. 4A and 4B. The connecting rods 154a, 154b and 154c are pivotally connected each at one end to the levers 118a, 118b and 118c by pins 158a, 158b and 158c and at the other ends thereof to the bell crank levers 156a, 156b and 156c by pins 160a, 160b and 160c, respectively. The bell crank levers 156a, 156b and 156c have their respective fulcrum portions rotatably mounted on a shaft 162 connected at both ends thereof to the side plates 58 and 58' of the frame structure 56 as shown in FIGS. 1 and 2. The shaft 162 thus supporting the bell crank levers 156a, 156b and 156c is substantially parallel with not only the shaft 116 supporting the levers 118a, 118b and 118c but the shaft 36 supporting the previously described length measuring rollers 34a, 34b and 34c as will be best seen in FIG. 1. The bell crank levers 156a, 156b and 156c each having one arm portion thus linked to each of the levers 118a, 118b and 118c are further pivotally connected to generally L-shaped roller support levers 164a, 164b and 164c by pins 166a, 166b and 166c, respectively, which are substantially parallel with the shaft 162 supporting the bell crank levers 156a, 156b and 156c. The respective shafts 42a, 42b and 42c of the pressing rollers 40a, 40b and 40c forming part of the previously described weft feeding and length-measuring mechanism 32 are mounted on these roller support levers 164a, 164b and 164c, respectively.

Each of the bell crank levers 156a, 156b and 156c and the associated one of the roller support levers 164a, 164b and 164c have respective end faces 168 and 170 tiltable into and out of contact with each other about the center axis of the pin 166a, 166b or 166c. Each of the roller support levers 164a, 164b and 164c is urged to turn about the center axis of the pin 166a, 166b or 166c toward an angular position having the end face 170 in contact with the end face 168 of the associated one of the bell crank levers 156a, 156b and 156c by suitable biasing means. The biasing means for the roller support levers 164a, 164b and 164c are shown in FIGS. 1 and 2 as comprising preloaded helical tension springs 172a, 172b and 172c which are anchored each at one end to projections 174a, 174b and 174c formed on the bell crank levers 156a, 156b and 156c, respectively, and at the other ends thereof to projections 176a, 176b and 176c formed on the roller support levers 164a, 164b and 164c, respectively.

The pressing rollers 40a, 40b and 40c supported on the roller support levers 164a, 164b and 164c by the shafts 42a, 42b and 42c, respectively, are integral with spur gears 178a, 178b and 178c, respectively, which are larger in diameter than the rollers 40a, 40b and 40c and which have center axes substantially coincident with those of the shafts 42a, 42b and 42c, respectively. The roller support levers 164a, 164b and 164c have arm portions which extend sidewise of the length measuring rollers 34a, 34b and 34c, respectively, and which have supported thereon drive rollers 180a, 180b and 180c, respectively, by means of shafts 182a, 182b and 182c substantially parallel with the shafts 42a, 42b and 42c carrying the pressing rollers 40a, 40b and 40c. The drive rollers 180a, 180b and 180c are rollable on the inner peripheral surfaces of the annular flanges 38a, 38b and 38c of the length measuring rollers 34a, 34b and 34c, respectively, and are integral with spur gears 184a, 184b and 184c, respectively, which are larger in diameter than the drive rollers 180a, 180b and 180c and which have center axes substantially coincident with those of the shafts 182a, 182b and 182c, respectively. The gears 184a, 184b and 184c integral with the drive rollers 180a, 180b and 180c are in constant mesh with the gears 178a, 178b and 178c integral with the pressing rollers 40a, 40b and 40c, respectively, so that each of the pressing rollers 40a, 40b and 40c is constantly driven to rotate about the center axis of the shaft 42a, 42b or 42c when the associated one of the drive rollers 180a, 180b and 180c is in rolling contact with the inner peripheral surface of the respective annular flange 38a, 38b or 38c of the length measuring roller 34a, 34b or 34c. The circumferential speed of rotation of each of the pressing rollers 40a, 40b and 40c thus driven by each of the length measuring rollers 34a, 34b and 34c, respectively, is substantially equal to that of the latter. The distance between the respective center axes of the pressing and drive rollers 40a and 180a, 40b and 180b or 40c and 180c on each of the roller support levers 164a, 164b and 164c is such that the drive roller 180a, 180b or 180c is in rolling contact with the annular flange 38a, 38b or 38c of the length measuring roller 34a, 34b or 34c, respectively, when the respectively associated pressing roller 40a, 40b or 40c is disengaged from the length measuring roller 34a, 34b or 34c, respectively, and, when the pressing roller 40a, 40b or 40c is in rolling contact with the length measuring roller 34a, 34b or 34c, respectively, then the respectively associated drive roller 180a, 180b or 180c is disengaged from the annular flange 38a, 38b or 38c of the length measuring roller 34a, 34b or 34c, respectively. The tension springs 172a, 172b and 172c respectively anchored to the bell crank levers 156a, 156b and 156c and the roller support levers 164a, 164b and 164c serve to urge the roller support levers 164a, 164b and 164c to turn about the respective center axes of the shafts 166a, 166b and 166c toward angular positions having the pressing rollers 40a, 40b and 40c disengaged from the respectively associated length measuring rollers 34a, 34b and 34c and accordingly having the drive rollers 180a, 180b and 180c in rollable contact with the inner peripheral surfaces of the annular flanges 38a, 38b and 38c of the respectively associated length measuring rollers 34a, 34b and 34c. The bell crank levers 156a, 156b and 156c and accordingly the roller support levers 164a, 164b and 164c are further urged to turn about the center axis of the shaft 162 toward angular positions having the pressing rollers 40a, 40b and 40c in rollable contact with the respectively associated length measuring rollers 34a, 34b and 34c by suitable biasing means such as preloaded helical tension springs 186a, 186b and 186c which are anchored each at one end to pins 188a, 188b and 188c projecting from the bell crank levers 156a, 156b and 156c, respectively, and at the other ends thereof to pins 190a, 190b and 190c, respectively, which are secured to a suitable stationary member (not shown) connected to or forming part of the frame structure 56. The roller support levers 164a, 164b and 164c have further supported thereon brackets 192a, 192b and 192c having fitted thereto weft guide elements 194a, 194b and 194c, respectively, which are adapted to have passed therethrough the weft yarns Wa, Wb and Wc to be forwardly conveyed between the length measuring and pressing rollers 34a and 40a, 34b and 40b and 34c and 40c, respectively, as shown in FIGS. 1 and 2.

Figure 5:
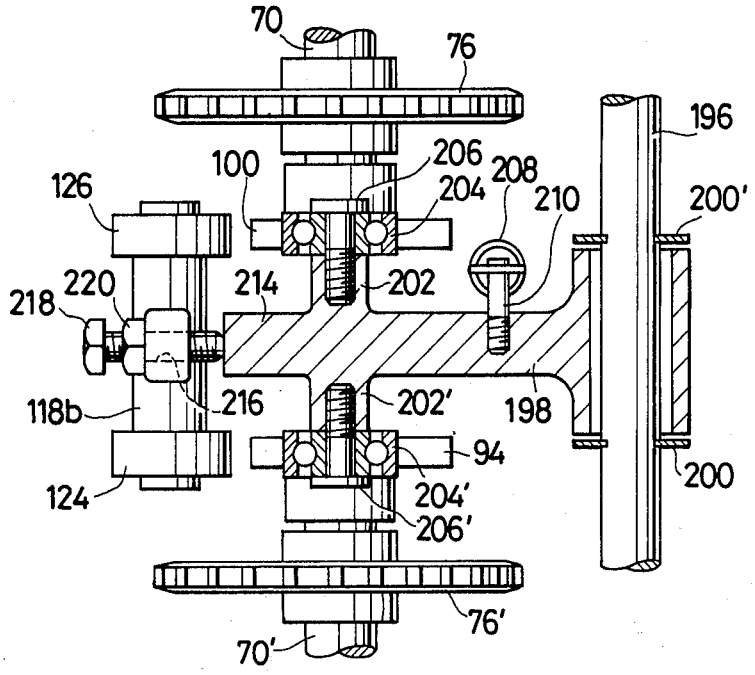
FIG. 5 is a sectional view taken along line V—V in FIG. 4A.

To the side plates 58 and 58' of the frame structure 56 (FIGS. 1 and 2) is further connected a shaft 196 extending below and in parallel with the shaft 162 supporting the bell crank levers 156a, 156b and 156c, as will be seen from FIGS. 4A and 4B. A lever 198 has an end portion rotatably mounted on this shaft 196 and is prevented from being moved in the axial direction of the shaft 196 by means of retaining rings 200 and 200' which are secured on both sides of the lever 198 to the shaft 196 as shown in FIG. 5. The lever 198 extends toward the laterally elongated leading end portion of the second lever 118*b* and has arm portions 202 and 202' extending in opposite directions to each other in parallel with the shaft 196 and the elongated leading end portion of the lever 118*b*. The arm portions 202 and 202' of the lever 198 have cam follower rollers 204 and 204' mounted thereon by means of pins 206 and 206', respectively, having respective center axes substantially aligned with each other and parallel with the center axes of the cam shafts 70 and 70' supporting the levers 118*a*, 118*b* and 118*c*. The cam follower rollers 204 and 204' are positioned below and engageable with the second and third inner cams 94 and 100 on the cam shafts 70 and 70', respectively. The second and third inner cams 94 and 100 on the cam shaft 70 and 70' are, thus, engageable with not only the cam follower rollers 124 and 126, respectively, on the lever 118 but the cam follower rollers 204 and 204' on the lever 198. The lever 198 is urged to turn about the center axis of the shaft 196 in a direction having the cam follower rollers 204 and 204' held in engagement with the cams 94 and 100, respectively, by suitable biasing means such as a preloaded helical tension spring 208 which is anchored at one end to a pin 210 secured to the lever 198 as shown in FIGS. 4A and 4B and at the other end to the previously mentioned spring retaining bar 86 shown in FIG. 1.

The lever 118*b* supporting the cam follower rollers 124 and 126 has an extension 212 projecting from the laterally elongated leading end portion thereof in a direction substantially perpendicular to the aligned axes of rotation of the cam follower rollers 204 and 204' and, likewise, the lever 198 supporting the cam follower rollers 204 and 204' has an extension 214 projecting from between the arm portions 202 and 202' in a direction substantially perpendicular to the aligned axes of rotation of the cam follower rollers 204 and 204' on the arm portions 202 and 202', respectively. The extension 212 of the lever 118*b* is formed with a tapped hole 216 and has a bolt 218 screwed through the tapped hole 216 toward the extension 214 of the lever 198 and secured to the lever 118*b* by means of a nut 220. The positional relationship between the extension 214 of the lever 198 and the bolt 218 thus fitted to the extension 214 of the lever 118*b* is such that, when both of the cam follower rollers 204 and 204' on the lever 198 are in contact with the respective small-diameter cam lobe portions 94*a* and 100*a* of the cams 94 and 100, respectively, the extension 214 of the lever 198 is axially aligned with the bolt 218 on the lever 118*b* so that the bolt 218 is engageable at its leading end with the end face of the extension 214 of the lever 198, as will be seen from FIG. 4A. When at least one of the cam follower rollers 204 and 204' on the lever 198 is in contact with the large-diameter cam lobe portion 94*a* or 100*a* of the associated one of the cams 94 and 100, the extension 214 of the lever 198 is held out of alignment with the bolt 218 on the lever 118*b*, as shown in FIG. 4B.

As shown in FIGS. 6A, 6B and 6C, the auxiliary weft retaining unit 54 of the weft retaining assembly 50 comprises a stationary body structure 222 formed with a horizontal bore 224 which is open at both ends and which is directed toward an intermediate portion of one of the first and second outer levers 142 and 142', i.e., the second outer lever 142' in the arrangement shown. The body structure 222 is further formed with three upper vertical bores 226*a*, 226*b* and 226*c* arranged in parallel with each other perpendicularly to the horizontal bore 224 and having respective inner ends commonly open to the horizontal bore 224 and three lower vertical bores 228*a*, 228*b* and 228*c* which are arranged in line with the upper vertical bores 226*a*, 226*b* and 226*c*, respectively, and which have respective inner ends commonly open to the horizontal bore 224. The upper vertical bores 226*a*, 226*b* and 226*c* have tapped and enlarged outer or upper end portions 230*a*, 230*b* and 230*c*, respectively, while the lower vertical bores 228*a*, 228*b* and 228*c* have enlarged outer or lower end portions 232*a*, 232*b* and 232*c*, respectively. The body structure 222 has secured thereto flanged first, second and third stationary weft retaining elements 234*a*, 234*b* and 234*c* which are screwed into the tapped outer or upper end portions 230*a*, 230*b* and 230*c* of the upper vertical bores 226*a*, 226*b* and 226*c*, respectively. The stationary weft retaining elements 234*a*, 234*b* and 234*c* are formed with axial bores 236*a*, 236*b* and 236*c*, respectively, having respective center axes aligned with the respective center axes of the upper and lower vertical bores 226*a* and 228*a*, 226*b* and 228*b*, and 226*c* and 228*c*, respectively. Guide rods 238*a*, 238*b* and 238*c* are axially slidably passed through the bores 236*a*, 236*b* and 236*c* in the weft retaining elements 234*a*, 234*b* and 234*c*, respectively, and axially extend in the upper and lower vertical bores 226*a* and 228*a*, 226*b* and 228*b*, and 226*c* and 228*c*, respectively, perpendicularly through the horizontal bore 224. The guide rods 238*a*, 238*b* and 238*c* have upper end portions projecting upwardly from the bores 236*a*, 236*b* and 236*c* in the weft retaining elements 234*a*, 234*b* and 234*c*, respectively, and have secured thereto flanged first, second and third movable weft retaining elements 240*a*, 240*b* and 240*c* by means of bolts 242*a*, 242*b* and 242*c*, respectively. The guide rods 240*a*, 240*b* and 240*c* being axially movable through the bores 236*a*, 236*b* and 236*c* in the stationary weft retaining elements 234*a*, 234*b* and 234*c*, respectively, each of the movable weft retaining elements 240*a*, 240*b* and 240*c* is axially movable into and out of a weft retaining position having its flange portion in contact with the flange portion of the associated one of the stationary weft retaining elements 234*a*, 234*b* and 234*c*. The movable weft retaining elements 240*a*, 240*b* and 240*c* are urged to stay in their respective weft retaining positions by suitable biasing means such as preloaded helical compression springs 244*a*, 244*b* and 244*c* which are seated each at one end on spring seat elements 246*a*, 246*b* and 246*c* attached to the lower end faces of the guide rods 238*a*, 238*b* and 238*c*, respectively, and at the other ends thereof on annular end faces formed at the inner or upper ends of the enlarged outer or lower end portions 232*a*, 232*b* and 232*c* of the lower vertical bores 228*a*, 228*b* and 228*c*, respectively, as shown in FIGS. 6A, 6B and 6C.

The guide rods 238*a*, 238*b* and 238*c* supporting the movable weft retaining elements 240*a*, 240*b* and 240*c* thus arranged are formed with lateral bores 248*a*, 248*b* and 248*c*, are respectively, which have respective center axes substantially parallel with the center axis of the horizontal bore 224 in the body structure 222 and each of which is open at both axial ends to the bore 224. An actuating rod 250 having first, second and third lateral protrusions 252*a*, 252*b* and 252*c* spaced apart from each other in the axial direction of the rod 250 is slidably passed through the lateral bores 248*a*, 248*b* and 248*c* thus formed in the guide rods 238*a*, 238*b* and 238*c*, respectively. The lateral protrusions 252*a*, 252*b* and 252*c* are engageable with the guide rods 238*a*, 238*b* and 238*c*, respectively, through the lateral bores 248*a*, 248*b* and 248*c* in the guide rods 238*a*, 238*b* and 238*c* depending upon the axial position of the actuating rod 250 with respect to the body structure 222. When the actuating rod 250 is in an axial position having one of the lateral protrusions 252*a*, 252*b* and 252*c* of the actuating rod 250 in engagement with the associated one of the guide rods 238*a*, 238*b* and 238*c*, the particular guide rod is upwardly moved against the force of the associated one of the compression springs 244*a*, 244*b* and 244*c* so that the movable weft retaining element 240*a*, 240*b* or 240*c* on the guide rod is moved to have its flange portion raised over the flange portion of the associated stationary weft retaining element 234*a*, 234*b* or 234*c*, respectively, as is the case with each of the guide rods 238*a*, 238*b* and 238*c* and the movable weft retaining elements 240*a*, 240*b* and 240*c* in the arrangements shown in FIGS. 6A, 6B and 6C, respectively. The lateral protrusions 252*a*, 252*b* and 252*c* of the actuating rod 250 thus configured are arranged so that the first, second and third lateral protrusions 252*a*, 252*b* and 252*c* are brought into engagement with the guide rods 238*a*, 238*b* and 238*c*, respectively, in this sequence when the actuating rod 250 is axially moved in one direction (viz., leftwardly in FIG. 1 and rightwardly in each of FIGS. 6A, 6B and 6C) through the horizontal bore 224 in the body structure 222. When one of the lateral protrusions 252*a*, 252*b* and 252*c* of the actuating rod 250 is in engagement with the associated one of the guide rods 238*a*, 238*b* and 238*c*, furthermore, the remaining two of the guide rods 238*a*, 238*b* and 238*c* are held out of engagement with the respectively associated ones of the guide rods and are maintained in the axial positions having the movable weft retaining elements 240*a* and 240*b*, 240*b* and 240*c*, or 240*c* and 240*a* held in the previously mentioned weft retaining positions having their respective flange portions pressed against the flange portions of the stationary weft retaining elements 234*a* and 234*b*, 234*b* and 234*c*, or 234*c* and 234*a*, respectively. The actuating rod 250 of the auxiliary weft retaining unit 54 thus constructed and arranged is linked to one of the previously described first and second outer levers 142 and 142' by means of a connecting rod 254 which is shown in FIGS. 6A, 6B and 6C as pivotally connected at one end to the actuating rod 250 by means of a pin 256 and at the other end to an intermediate portion of the second outer lever 142' by means of a pin 258.

In FIGS. 6A, 6B and 6C, the valve body 22 of the previously mentioned fluid distribution valve unit 20 is shown to be formed with first, second and third fluid inlet ports 260*a*, 260*b* and 260*c* each open at one end to the axial bore 28 in the valve body 22 and first, second and third fluid outlet ports 262*a*, 262*b* and 262*c* which are aligned with the first, second and third fluid inlet ports 260*a*, 260*b* and 260*c*, respectively, laterally across the axial bore 28 and which are open each at one end to the bore 28. The fluid inlet ports 260*a*, 260*b* and 260*c* are in constant communication with the previously mentioned power-driven pump through a fluid supply passageway 264 formed in the valve body 22. The fluid outlet ports 262*a*, 262*b* and 262*c* are in constant communication with the passageways in the fluid feed conduits 24*a*, 24*b* and 24*c*, respectively, leading to the weft shooting nozzles 12*a*, 12*b* and 12*c* of the weft shooting unit 10 shown in FIG. 1. In FIGS. 6A, 6B and 6C, furthermore, the valve spool 30 axially slidable through the bore 28 in the valve body 22 is shown formed with first, second, third and fourth circumferential lands 266*a*, 266*b*, 266*c* and 266*d* which are axially spaced apart from each other so as to form first, second and third circumferential grooves 268*a*, 268*b* and 268*c* therebetween. The first, second and third circumferential grooves 268*a*, 268*b* and 268*c* in the valve spool 30 are laterally open to the first, second and third fluid inlet and outlet ports 260*a* and 262*a*, 260*b* and 262*b*, and 260*c* and 262*c*, respectively, in the valve body 22 depending upon the axial position of the valve spool 30 with respect to the valve body 22 as is the case with each of the first, second and third circumferential grooves 268*a*, 268*b* and 268*c* in the arrangements shown in FIGS. 6A, 6B and 6C, respectively. When the valve spool 30 is in an axial position having one of the circumferential grooves 268*a*, 268*b* and 268*c* laterally aligned with the associated fluid inlet and outlet ports 260*a* and 262*a*, 260*b* and 262*b*, or 260*c* and 262*c*, the remaining two of the grooves are held out of alignment with the respectively associated ones of the fluid inlet and outlet ports. The fluid inlet and outlet ports in the valve body 22 and the circumferential lands of the valve spool 30 are arranged so that the first, second and third circumferential grooves 268*a*, 268*b* and 268*c* in the valve spool 30 are permitted to be open to the first, second and third fluid inlet and outlet ports 260*a* and 262*a*, 260*b* and 262*b*, and 260*c* and 262*c*, respectively, in this sequence when the valve spool 30 is axially moved in one direction (viz., leftwardly in FIG. 1 or rightwardly in each of FIGS. 6A, 6B and 6C) through the axial bore 28 in the valve body 22. The valve spool 30 of the fluid distributor valve unit 20 thus constructed and arranged is linked to one of the first and second outer levers 142 and 142' by means of a connecting rod 270 which is shown in FIGS. 6A, 6B and 6C as pivotally connected at one end to the valve spool 30 by a pin 272 and at the other end to an intermediate portion of the second outer lever 142' by a pin 274.

The second outer lever 142' thus linked to the actuating rod 250 of the auxiliary weft retaining unit 54 and the valve spool 30 of the fluid distributor valve unit 20 is rotatable about the center axis of the shaft 116 between three different angular positions depending upon the angular positions of the first and second outer cams 108 and 110 engageable with the cam follower rollers 146 and 146' on the first and second outer levers 142 and 142', respectively. When both of the first and second outer cams 108 and 110 have their respective small-diameter cam lobe portions 108*a* and 110*a* concurrently in contact with the cam follower rollers 146 and 146' on the first and second outer levers 142 and 142', respectively, each of the levers 142 and 142' assumes about the center axis of the shaft 116 a first angular position having each of the cam follower rollers 146 and 146' located closest to the center axis of each of the cam shafts 70 and 70', as will be seen from FIG. 6A. When the second outer cam 110 has its large-diameter cam lobe portion 110*b* in contact with the cam follower roller 146' on the second outer lever 142', each of the levers 142 and 142' assumes about the center axis of the shaft 116 a third angular position having each of the cam follower rollers 146 and 146' located remotest from the center axis of each of the cam shafts 70 and 70', as will be seen from FIG. 6C. When, furthermore, the first outer cam 108 has its large-diameter cam lobe portion 108*b* contacted by the associated cam follower roller 146 on the first outer lever 142 and at the same time the second outer cam 110 has its small-diameter cam lobe portion 110*a* contacted by the associated cam follower roller 146' on the second outer lever 142', then each of the levers 142 and 142' assumes about the center axis of the shaft 116 a second angular position angularly intervening between the above mentioned first and third angular positions of each of the levers 142 and 142', as will be seen from FIG. 6B.

When the second outer lever 142' is in the first angular position about the center axis of the shaft 116, the actuating rod 250 of the auxiliary weft retaining unit 54 assumes a first axial position having the first lateral protrusion 252*a* engaged by the guide rod 238*a* carrying the first movable weft retaining element 240*a* and at the same time the valve spool 30 of the fluid distributor valve unit 20 assumes a first axial position having the first circumferential groove 268*a* laterally aligned with and accordingly open to the first fluid inlet and outlet ports 260*a* and 262*a* in the valve body 22, as shown in FIG. 6A. The actuating rod 250 thus held in the first axial position thereof has its second and third lateral protrusions 252*b* and 252*c* disengaged from the guide rods 238*b* and 238*c* carrying the second and third movable weft retaining elements 240*b* and 240*c*, respectively, and the valve spool 30 held in the first axial position thereof closes the second fluid inlet and outlet ports 260*b* and 262*b* and the third fluid inlet and outlet ports 260*c* and 262*c* by its third and fourth circumferential lands 266*c* and 266*d*, respectively.

When the second outer lever 142' is in the second angular position about the center axis of the shaft 116, then the actuating rod 250 of the auxiliary weft retaining unit 54 assumes a second axial position having the second lateral protrusion 252*b* engaged by the guide rod 238*b* carrying the second movable weft retaining element 240*b* and, simultaneously, the valve spool 30 of the fluid distributor valve 20 assumes a second axial position having the second circumferential groove 268*b* laterally aligned with and open to the second fluid inlet and outlet ports 260*b* and 262*b* in the valve body 22, as shown in FIG. 6B. The actuating rod 250 thus held in the second axial position thereof has its first and third lateral protrusions 252*a* and 252*c* disengaged from the guide rods 238*a* and 238*c* carrying the first and third movable weft retaining elements 240*a* and 240*c*, respectively, and the valve spool 30 held in the second axial position thereof closes the first fluid inlet and outlet ports 260*a* and 262*a* and the third fluid inlet and outlet ports 260*c* and 262*c* by its first and fourth circumferential lands 266*a* and 266*d*, respectively.

When, furthermore, the outer lever 142' is in the third angular position about the center axis of the shaft 116, the acutating rod 250 of the auxiliary weft retaining unit 54 assumes a third axial position having the third lateral protrusion 252*c* engaged by the guide rod 238*c* carrying the third movable weft retaining element 240*c* and, at the same time, the valve spool 30 of the fluid distributor valve unit 20 assumes a third axial position having the third circumferential groove 268*c* laterally aligned with and open to the third fluid inlet and outlet ports 260*c* and 262*c* in the valve body 22, as shown in FIG. 6C. The actuating rod 250 thus held in the third axial position thereof has its first and second lateral protrusions 252*a* and 252*b* disengaged from the guide rods 238*a* and 238*b* carrying the first and second movable weft retaining elements 240*a* and 240*b*, respectively, and the valve spool 30 held in the third axial position thereof closes the first fluid inlet and outlet ports 260*a* and 262*a* and the second fluid inlet and outlet ports 260*b* and 262*b* by its first and second circumferential lands 266*a* and 266*b*, respectively.

As illustrated in FIG. 1, the auxiliary weft retaining unit 54 further comprises weft guide elements 276*a*, 276*b* and 276*c* jointly mounted on a support member 278 fixed to the body structure 222 so that the weft yarns Wa, Wb and Wc respectively leading from the open outlet ends of the weft detaining tubes 44*a*, 44*b* and 44*c* and passed through the guide elements 48*a*, 48*b* and 48*c* above the detaining tubes are further passed through the weft guide elements 276*a*, 276*b* and 276*c*, respectively, and past and these guide elements extend between the stationary and movable weft retaining elements 234*a* and 240*a*, 234*b* and 240*b*, and 234*c* and 240*c*, respectively, of the auxiliary weft retaining unit 54 toward the main weft retaining unit 52.

In FIG. 1, the main weft retaining unit 52 is shown comprising first, second and third stationary weft retaining elements 280*a*, 280*b* and 280*c* and first, second and third movable weft retaining elements 282*a*, 282*b* and 282*c* which are movable as a single unit into and out of contact with the stationary weft retaining elements 280*a*, 280*b* and 280*c*, respectively. Though not shown in the drawings, the movable weft retaining elements 282*a*, 282*b* and 282*c* of the main weft retaining unit 52 are jointly connected to or engaged by a suitable intermittent-motion drive mechanism adapted to move these weft retaining elements 282*a*, 282*b* and 282*c* away from the respectively associated stationary weft retaining elements 280*a*, 280*b* and 280*c* all concurrently during each cycle of operation of the loom. The weft yarns Wa, Wb and Wc leading from the auxiliary weft retaining unit 54 are passed through guide elements 284*a*, 284*b* and 284*c*, respectively, mounted on a stationary support member 286 positioned between the main and auxiliary weft retaining units 52 and 54 and, past these guide elements, extend between the stationary and movable weft retaining elements 280*a* and 282*a*, 280*b* and 282*b*, and 280*c* and 282*c*, respectively, of the main weft retaining unit 52. Between the main weft retaining unit 52 and the previously described weft inserting unit 10 are provided weft guide elements 288*a*, 288*b* and 288*c* mounted on a stationary support member 290 so that the weft yarns Wa, Wb and Wc extending from the main weft retaining unit 52 are passed through these guide elements 288*a*, 288*b* and 288*c* to the weft shooting nozzles 12*a*, 12*b* and 12*c*, respectively, of the weft retaining unit 10.

The operation of the apparatus thus constructed and arranged in accordance with the present invention will be hereinafter described with concurrent reference to FIGS. 1 to 6C of the drawings.

Assuming that the dobby head 14 shown in FIG. 2 is in a condition having one lever 90 in the previously mentioned first angular position thereof and the other lever 90' in the previously mentioned second angular position thereof, the rope 84 connected to the former lever is pulled toward the associated sprocket wheel 76 by the force of the tension spring 82 and the rope 84' connected to the latter lever is pulled away from the associated sprocket wheel 76' against the force of the tension spring 82'. The cam shafts 70 and 70' carrying the sprocket wheels 76 and 76', respectively, are therefore held in their respective first and second rotational positions about the center axes thereof. The first and second inner cams 92 and 94 on the cam shaft 70 thus held in the first rotational position thereof are in angular positions having their respective small-diameter and large-diameter cam lobe portions 92a and 94b oriented toward the cam follower rollers 120 and 124 on the first and second inner levers 118a and 118b, respectively, as shown in FIG. 3A. On the other hand, the third and fourth inner cams 100 and 102 on the cam shaft 70' held in the second rotational position thereof are in angular positions having their respective small-diameter and large-diameter cam lobe portions 100a and 102b oriented toward the cam follower rollers 126 and 132 on the second and third inner levers 118b and 118c, respectively, as also shown in FIG. 3A. Under these conditions, the cam follower roller 120 on the first inner lever 118a is in contact with (or, actually in close proximity to) the small-diameter cam lobe portion 92a of the first inner cam 92 and the cam follower rollers 124 and 132 on the second and third inner levers 118b and 118c are in contact with the respective large-diameter cam lobe portions 94b and 102b of the second and fourth inner cams 94 and 102, respectively. The cam follower roller 126 on the second inner lever 118b is confronted by but disengaged from the small-diameter cam lobe portion 100a of the third inner cam 100 because the other cam follower 124 on the lever 118b is in contact with the large-diameter cam lobe portion 94b of the second inner cam 94, as will be seen from FIG. 3A. Thus, the first inner lever 118a is held in an angular position closest to the center axis of the cam shaft 70 by the force of the associated tension spring 136a (FIG. 1), while the second and third inner levers 118b and 118c are held in angular positions remotest from the respective center axes of the cams shafts 70 and 70', respectively, by the forces of the respectively associated tension springs 136b and 136c (FIG. 1). The first inner lever 118a being in the angular position closest to the center axis of the cam shaft 70, the first bell crank lever 156a linked to the lever 118a by the connected rod 154a is held in an angular position having the associated roller support lever 164a in an angular position in which the first pressing roller 40a supported on the lever 164a is rolling contact with the first length measuring roller 34a rotating with the shaft 36 (FIG. 2). With the second and third inner levers 118b and 118c held in the angular positions remotest from the center axes of the cam shafts 70 and 70', respectively, the second and third bell crank levers 156b and 156c linked to the levers 118b and 118c by the connecting rods 154b and 154c, respectively, are held in angular positions having the respectively associated second and third pressing rollers 40b and 40c disengaged from the second and third length measuring rollers 34b and 34c, respectively. The roller support lever 164a having the first pressing roller 40a thus held in rolling contact with the first length measuring roller 34a is forced to press the pressing roller 40a against the outer peripheral surfaces of the rotating length measuring roller 34a by the force of the tension spring 186a and has its end face 170 closely contacted by the end face 168 of the associated bell crank lever 156a. The weft yarn Wa extending between the first length measuring and pressing rollers 34a and 40a is therefore conveyed a predetermined length through these rollers for a period of time for which the pressing roller 40a is permitted to stay on the length measuring roller 34a. The weft yarn Wa thus conveyed past the length measuring and pressing rollers 34a and 40a is fed into the weft detaining tube 44a through the tubular projection 46a of the tube and is temporarily stored therein in a hair-pin curved form by the aid of the suction established in the tube. When each of the pressing rollers 40a, 40b and 40c is in rolling contact with the respectively associated one of the length measuring rollers 34a, 34b and 34c, the roller support lever 164a, 164b or 164c is forced to have its end face 170 in contact with the end face 168 of the associated bell crank lever 156a, 156b and 156c, respectively, so that the bell crank and rollers support levers 156a and 164a, 156b and 164b, or 156c and 164c act as a rigid single unit. To hold the pressing roller 40a, 40b or 40c in contact with the associated length measuring roller 34a, 34b and 34c by a proper force exerted mainly by each of the springs 186a, 186b and 186c, each of the respective small-diameter cam lobe portions 92a, 94a, 100a and 102a of the cams 92, 94, 100 and 102 is so sized as to provide a slight allowance between the particular portion and the associated one of the cam follower rollers 120, 124, 126 and 132 when each of the cams has an angular position having its small-diameter cam lobe portion oriented by the associated cam follower roller.

The second and third pressing rollers 40b and 40c being disengaged from the second and third length measuring rollers 34b and 34c, respectively, the drive rollers 180b and 180c on the bent arm portions of the roller support levers 164b and 164c are in rolling contact with the inner peripheral surfaces of the flange portions 38b and 38c of the second and third length measuring rollers 34b and 34c, respectively, so that the pressing rollers 40b and 40c disengaged from the length measuring rollers 34b and 34c being driven for rotation about the center axis of the shaft 36 are enabled to continue their rotation about the center axes of the pins 42b and 42c on the levers 164b and 164c by means of the gears 184b and 184c integral with the drive rollers 180b and 180c and the gears 178b and 178c in mesh with the gears 184b and 184c, respectively, and integral with the pressing rollers 40b and 40c, respectively. With the drive rollers 180b and 180c being held in rolling contact with the inner peripheral surfaces of the flange portions 38b and 38c of the length measuring rollers 34b and 34c, respectively, the roller support levers 164b and 164c carrying the second and third pressing rollers 40b and 40c are urged to turn about the pins 166b and 166c, respectively, in directions to have their respective end faces 170 angularly spaced apart from the respective end faces 168 of the second and third bell crank levers 156b and 156c, respectively. The roller support levers 164b and 164c are enabled to hold the drive rollers 180b and 180c in rolling contact with the flange portions 38b and 38c of the length measiring rollers 34b and 34c, respectively, against such tendencies by virtue of the forces of the tension springs 172b and 172c urging the roller support levers 164b and 164c to turn in the reverse directions about the pins 166b and 166c, respectively. Thus, the second and third pressing rollers 40b and 40c disengaged from the second and third length measuring rollers 34b and 34c are kept driven for rotation about the center axes of the pins 42b and 42c with circumferential velocities substantially equal to the circumferential speeds of rotation of the length measuring rollers 34b and 34c by means of the drive rollers 180b and 180c maintained in rolling contact with the flange portions 38b and 38c of the length measuring rollers 34b and 34c by the forces of the tension springs 172b and 172c, respectively. With the second and third pressing rollers 40b and 40c spaced apart from the respectively associated length measuring rollers 34b and 34c, the weft yarns Wb and Wc extending between the length measuring and pressing rollers 34*b* and 40*b*, and 34*c* and 40*c*, respectively, are maintained in situ so that there is no weft yarn detained in each of the weft detaining tubes 44*b* and 44*c* respectively associated with these length measuring and pressing rollers.

The cam shafts 70 and 70' being held in their respective first and second rotational positions thereof, the first and second outer cams 108 and 110 on the shafts 70 and 70' assume angular positions having their respective small-diameter cam lobe portions 108*a* and 110*a* contacted by the cam follower rollers 146 and 146' on the outer levers 142 and 142', respectively, as will be seen from FIG. 6A. Under these conditions, each of the outer levers 142 and 142' is held in the previously mentioned first angular position about the center axis of the shaft 116 so that the actuating rod 250 of the auxiliary weft retaining unit 54 and the valve spool 30 of the fluid distributor valve unit 20 are held in their respective first axial positions as previously described. The actuating rod 250 of the auxiliary weft retaining unit 54 being held in the first axial position thereof, the first lateral protrusion 252*a* of the actuating rod 250 is received in the lateral bore 248*a* in the first guide rod 238*a* of the weft retaining unit 54 and holds the guide rod 238*a* in a raised axial position having the movable weft retaining element 240*a* upwardly spaced apart from the associated stationary weft retaining element 234*a* against the force of the compression spring 244*a*, as shown in FIG. 6A. When the actuating rod 250 is in the first axial position thereof, the second and third lateral protrusions 252*b* and 252*c* of the rod 250 are located outside the lateral bores 248*b* and 248*c* in the respectively associated guide rods 238*b* and 238*c* so that the second and third movable weft retaining elements 240*b* and 240*c* are maintained in their respective weft retaining positions pressed against the respectively associated stationary weft retaining elements 234*b* and 234*c* by the forces of the compression springs 244*b* and 244*c*, respectively. Thus, only the weft yarn Wa extending between the first stationary and movable weft retaining elements 234*a* and 240*a* is released from the auxiliary weft retaining unit 54 when the actuating rod 250 of the unit 54 is in the first axial position thereof.

The valve spool 30 of the fluid distributor valve unit 20 being held in the first axial position thereof, the first circumferential groove 268*a* in the valve spool 30 is laterally aligned with the first fluid inlet and outlet ports 260*a* and 262*b*, providing communication between the fluid supply passageway 264 and the fluid feed conduit 24*a* leading to the first weft shooting nozzle 12*a* of the weft inserting unit 10. When the valve spool 30 is in the first axial position thereof, the second fluid inlet and outlet ports 260*b* and 262*b* and the third fluid inlet and outlet ports 260*c* and 262*c* are closed by the third and fourth circumferential lands 266*c* and 266*d*, respectively, of the valve spool 30 so that the passageways in the fluid feed conduits 24*b* and 24*c* leading to the second and third weft shooting nozzles 12*b* and 12*c*, respectively, are isolated from the fluid supply passageway 264.

When fluid under pressure is supplied to the fluid supply passageway 264 in the fluid distributor unit 20 thus conditioned, the pressurized fluid is passed by way of the first fluid inlet port 260*a*, the first circumferential groove 268*a* in the valve spool 30 and the first fluid outlet port 262*a* to the fluid feed conduit 24*a* and further through the conduit 24*a* to the first weft shooting nozzle 12*a* of the weft inserting unit 10 and is ejected from the nozzle 12*a* into a weaving shed formed by two sets of warp yarns adjacent the weft inserting unit 10. At a timing somewhat later than the instant at which a jet stream of fluid is thus shot into the weaving shed, the main weft retaining unit 52 is actuated to move the movable weft retaining elements 282*a*, 282*b* and 282*c* away from the respectively associated stationary weft retaining elements 280*a*, 280*b* and 280*c* of the weft retaining unit 52 (FIG. 1). All the weft yarns Wa, Wb and Wc are thus released from the main weft retaining unit 52 but only the weft yarn Wa leading to the first weft shooting nozzle 12*a* is permitted to travel forwardly through the main weft retaining unit 52 because the other weft yarns Wb and Wc are held retained to the auxiliary weft retaining unit 54 as previously discussed. The weft yarn Wa thus released from the main and auxiliary weft retaining units 52 and 54 has its leading end portion entrained on the jet stream of the fluid being ejected from the first weft shooting nozzle 12*a* and is inserted through the weaving shed of the warp yarns. The insertion of the weft yarn Wa thus effected is followed by beating up of the yarn Wa onto the fell of the woven fabric (not shown) as is well known in the art. If the weft yarn Wa is to be inserted repeatedly in consecutive cycles of operation of the loom, the conditions established are maintained throughout the cycles of operation so that the weft yarn Wa can be shot from the first weft shooting nozzle 12*a* each time the main weft retaining unit 52 is actuated during the consecutive cycles of operation.

When, on the other hand, the dobby head 14 is in a condition having both of the levers 90 and 90' is their respective second angular positions, the ropes 84 and 84' connected to the levers 90 and 90' are pulled away from the respectively associated sprocket wheels 76 and 76' against the forces of the tension springs 82 and 82'. Both of the cam shafts 70 and 70' carrying the sprocket wheels 76 and 76' are accordingly held in their respective second rotational positions about the center axes thereof. Thus, the first and second inner cams 92 and 94 on the cam shaft 70 are in angular positions having their respective large-diameter and small-diameter cam lobe portions 92*b* and 94*a* oriented toward the cam follower rollers 120 and 124, respectively, and at the same time the third and fourth inner cams 100 and 102 on the cam shaft 70' are in the angular positions having their respective small-diameter and large-diameter cam lobe portions 100*a* and 102*b* oriented toward the cam follower rollers 126 and 132, as shown in FIG. 3B. Under these conditions, the cam follower rollers 120 and 132 on the first and third inner levers 118*a* and 118*c* are in contact with the respective large-diameter cam lobe portions 92*b* and 102*b* of the first and fourth inner cams 92 and 102, respectively, while the cam follower rollers 124 and 126 on the second inner lever 118*b* are in contact with (or in proximity to) the respective small-diameter cam lobe portions 94*a* and 100*a* of the second and third inner cams 94 and 100. As a consequence, each of the first and third inner levers 118*a* and 118*c* is held in an angular position remotest from the center axis of each of the cam shafts 70 and 70' and the second inner lever 118*b* is held in an angular position closest to the center axes of the cam shafts 70 and 70'. The first and third bell crank levers 156*a* and 156*c* connected to the levers 118*a* and 118*c*, respectively, are therefore held in angular positions having the respectively associated pressing rollers 40*a* and 40*c* disengaged from the first and third length measuring rollers 34*a* and 34*c*, respectively, while the second bell crank lever 156*b* connected to the lever 118*b* is held in an angular position having the associated pressing roller 40*b* contacted by the second length measuring roller 34*b*. The roller support lever 164*b* having the second pressing roller 40*b* thus held in rolling contact with the second length measuring roller 34*b* is forced to press the pressing roller 40*b* against the outer peripheral surface of the length measuring roller 34*b* by the tension spring 186*b* and has its end face 170 closely contacted by the end face 168 of the associated bell crank lever 156*b*. The weft yarn Wb extending between the second length measuring and pressing rollers 34*b* and 40*b* is therefore conveyed a predetermined length through these rollers into the weft detaining tube 44*b*. The first and third pressing rollers 40*a* and 40*c* being disengaged from the respectively associated length measuring rollers 34*a* and 34*c*, furthermore, the drive rollers 180*a* and 180*c* on the respective bent arm portions of the roller support levers 164*a* and 164*c* are held in rolling contact with the inner peripheral surfaces of the flange portions 38*a* and 38*c* of the first and third length measuring rollers 34*a* and 34*c* by the forces of the tension springs 172*a* and 172*c*, respectively. The first and third pressing rollers 40*a* and 40*c* are, thus, kept driven for rotation about the center axes of the pins 42*a* and 42*c*, respectively, with circumferential speeds substantially equal to the circumferential speeds of rotation of the first and third length measuring rollers 34*a* and 34*c*, as previously described with respect to the second and third pressing rollers 40*b* and 40*c*. With the first and third pressing rollers 40*a* and 40*c* spaced apart from the respectively associated length measuring rollers 34*a* and 34*c*, the weft yarns Wa and Wc extending between the length measuring and pressing rollers 34*a* and 40*a*, and 34*c* and 40*c*, respectively, are maintained in situ so that there is no weft yarn detained in each of the weft detaining tubes 44*a* and 44*c*.

Both of the cam shafts 70 and 70' being held in their respective second rotational positions about the center axes thereof, the first and second outer cams 108 and 110 on the shafts 70 and 70' assume angular positions having their respective large-diameter and small diameter cam lobe portions 108*b* and 110*a* contacted by the cam follower rollers 146 and 146' on the outer levers 142 and 142', respectively, as will be seen from FIG. 3B. Under these conditions, each of the outer levers 142 and 142' is held in the previously mentioned second angular position about the center axis of the shaft 116 so that the actuating rod 250 of the auxiliary weft retaining unit 54 and the valve spool 30 of the fluid distributor valve unit 20 are held in their respective second axial positions. The actuating rod 250 of the auxiliary weft retaining unit 54 being held in the second axial position thereof, the second lateral protrusion 252*b* of the actuating rod 250 is received in the lateral bore 248*b* in the guide rod 238*b* of the weft retaining unit 54 and holds the guide rod 238*b* in a raised axial position having the second movable weft retaining element 240*b* spaced apart upwardly from the associated stationary weft retaining element 234*b* against the force of the compression spring 244*b*, as shown in FIG. 6B. When the actuating rod 250 is in the second axial position thereof, the first and third lateral protrusions 252*a* and 252*c* of the actuating rod 250 are located outside the lateral bores 248*a* and 248*c* in the guide rods 238*a* and 238*c*, respectively, so that the first and third moveable weft retaining elements 240*a* and 240*c* are maintained in their respective weft retaining positions pressed against the respectively associated stationary weft retaining elements 234*a* and 234*c* by the forces of the compression springs 244*a* and 244*c*, respectively. Thus, only the weft yarn Wb extending between the second stationary and movable weft retaining elements 234*b* and 240*b* is released from the auxiliary weft retaining unit 54 when the actuating rod 250 of the unit 54 is in the second axial position thereof.

The valve spool 30 of the fluid distributor valve unit 20 being held in the second axial position thereof, the second circumferential groove 268*b* in the valve spool 30 is laterally aligned with the second fluid inlet and outlet ports 260*b* and 262*b*, providing communication between the fluid supply passageway 264 and the fluid feed conduit 24*b* leading to the second weft shooting nozzle 12*b* of the weft inserting unit 10. When the valve spool 30 is in the second axial position thereof, the first fluid inlet and outlet ports 260*a* and 262*a* and the third fluid inlet and outlet ports 260*c* and 262*c* are closed by the first and fourth circumferential lands 266*a* and 266*d*, respectively, of the valve spool 30 so that the passageways in the fluid feed conduits 24*a* and 24*c* leading to the first and third weft shooting nozzles 12*a* and 12*c*, respectively, are isolated from the fluid supply passageway 264.

When fluid under pressure is introduced into the fluid supply passageway 264 of the fluid distributor valve unit 20 thus conditioned, the pressurized fluid is passed by way of the fluid inlet port 260*b*, the second circumferential groove 268*b* in the valve spool 30 and the second fluid outlet port 262*b* to the second weft shooting nozzle 12*b* of the weft inserting unit 10 and is ejected from the nozzle 12*b* into the weaving shed of warp yarns. Immediately after a jet stream of fluid is thus injected into the weaving shed, the main weft retaining unit 52 is actuated to move the movable weft retaining elements 282*a*, 282*b* and 282*c* away from the stationary weft retaining elements 280*a*, 280*b* and 280*c*, respectively, of the main weft retaining unit 52. All the weft yarns Wa, Wb and Wc are thus released from the main weft retaining unit 52 but only the weft yarn Wb leading to the second weft shooting nozzle 12*b* is permitted to travel forwardly through the main weft retaining unit 52. The weft yarn Wb thus released from the main and auxiliary weft retaining units 52 and 54 has its leading end portion entrained on the jet stream of the fluid ejected from the second weft shooting nozzle 12*b* and is inserted through the weaving shed of the warp yarns.

When, furthermore, the dobby head 14 is in a condition having the lever 90 in the second angular position thereof and the lever 90' in the first angular position thereof as indicated in FIG. 1, the rope 84 connected to the former lever is pulled away from the sprocket wheel 76 against the force of the tension spring 82 while the rope 84' connected to the latter lever is pulled toward the sprocket wheel 76' by the force of the tension spring 82'. The cam shafts 70 and 70' carrying the sprocket wheels 76 and 76', respectively, are therefore held in their respective second and first rotational positions about the center axes thereof. The first and second inner cams 92 and 94 on the cam shaft 70 are in the angular positions having their respective large-diameter and small-diameter cam lobe portions 92*b* and 94*a* oriented toward the cam follower rollers 120 and 124 on the first and second inner levers 118*a* and 118*b*, respectively, and the third and fourth inner cams 100 and 102 on the cam shaft 70' are in the angular positions having their respective large-diameter and small-diameter cam lobe portions 100*b* and 102*a* oriented toward the cam follower rollers 126 and 132 on the second and third inner levers 118*b* and 118*c*, respectively, as shown in FIG. 3C. Under these conditions, the cam follower rollers 120 and 126 on the first and second inner levers 118*a* and 118*b* are in contact with the respective large-diameter cam lobe portions 92*b* and 100*b* of the first and third inner cams 92 and 100, respectively, while the cam follower roller 132 on the third inner lever 118*c* is in contact with (or in proximity to) the small-diameter cam lobe portion 102*a* of the fourth inner cam 102. The cam follower roller 124 on the second inner lever 118*b* is confronted by the small-diameter cam lobe portion 94*a* of the second inner cam 94 but is disengaged therefrom because the other cam follower roller 126 on the second inner lever 118*b* is in contact with the large-diameter cam lobe portion 100*b* of the third inner cam 100, as will be seen from FIG. 3C. Thus, each of the first and second inner levers 118*a* and 118*b* is held in the angular position remotest from the center axis of each of the cam shafts 70 and 70', while the third inner lever 118*c* is held in the angular position closest to the center axis of the shaft 70'. The first and second bell crank levers 156*a* and 156*b* connected to the levers 118*a* and 118*b*, respectively, are therefore held in the angular positions having the respectively associated pressing rollers 40*a* and 40*b* disengaged from the first and second length measuring rollers 34*a* and 34*b*, respectively, while the third bell crank lever 156*c* connected to the lever 118*c* is held in the angular position having the associated pressing roller 40*c* contacted by the third length measuring roller 34*c*. The roller support lever 164*c* having the third pressing roller 40*c* thus held in rolling contact with the third length measuring roller 34*c* is forced to press the pressing roller 40*c* on the outer peripheral surface of the length measuring roller 34*c* by the force of the tension spring 186*c* with the result that the weft yarn W*c* extending between the third length measuring and pressing rollers 34*c* and 40*c* is conveyed a predetermined length through these rollers into the weft detaining tube 44*c*. The first and second pressing rollers 40*a* and 40*b* being disengaged from the respectively associated length measuring rollers 34*a* and 34*b*, the drive rollers 180*a* and 180*b* on the roller support levers 164*a* and 164*b* are held in rolling contact with the respective inner peripheral surfaces of the flange portions 38*a* and 38*b* of the first and second length measuring rollers 34*a* and 34*b* by the forces of the tension springs 172*a* and 172*b*, respectively, thereby driving the first and second pressing rollers 40*a* and 40*b* for rotation on the pins 42*a* and 42*b* at circumferential speeds substantially equal to the circumferential speeds of rotation of the length measuring rollers 34*a* and 34*b*, respectively. With the first and second pressing rollers 40*a* and 40*b* spaced apart from the respectively associated length measuring rollers 34*a* and 34*b*, the weft yarns Wa and Wb extending between the first and second length measuring rollers 34*a* and 40*a*, and 34*b* and 40*b*, respectively, are maintained in situ so that there is no weft yarn detained in each of the weft detaining tubes 44*a* and 44*b* associated with these rollers.

The cam shafts 70 and 70' being held in their respective second and first rotational positions thereof, the first and second outer cams 108 and 110 on the cam shafts 70 and 70' assume angular positions having their respective large-diameter cam lobe portions 108*b* and 110*b* contacted by the cam follower rollers 146 and 146' on the outer levers 142 and 142', respectively, as will be seen from FIG. 3C. Under these conditions, each of the outer levers 142 and 142' is held in the previously mentioned third angular position about the center axis of the shaft 116 so that the actuating rod 250 of the auxiliary weft retaining unit 54 and the valve spool 30 of the fluid distributor valve 20 are held in their respective third axial positions. The actuating rod 250 of the auxiliary weft retaining unit 54 being held in the third axial position thereof, the third lateral protrusion 252*c* of the actuating rod 250 is received in the lateral bore 248*c* in the guide rod 238*c* of the weft retaining unit 54 and holds the guide rod 238*c* in a raised axial position having the third movable weft retaining element 240*c* spaced apart upwardly from the associated stationary weft retaining element 234*c* against the force of the compression spring 244*c*, as shown in FIG. 6C. When the actuating rod 250 is in the third axial position thereof, the first and second lateral protrusions 252*a* and 252*b* of the rod 250 are located outside the lateral bores 248*a* and 248*b* in the guide rods 238*a* and 238*b*, respectively, so that the first and second movable weft retaining elements 240*a* and 240*b* are maintained in their respective weft retaining positions pressed against the respectively associated stationary weft retaining elements 234*a* and 234*b* by the forces of the compression springs 244*a* and 244*b*, respectively. Only the weft yarn Wc extending between the third stationary and movable weft retaining elements 234*c* and 240*c* is released from the auxiliary weft retaining unit 54 when the actuating rod 250 of the unit 54 is in the third axial position thereof.

The valve spool 30 of the fluid distributor valve unit 20 being held in the third axial position thereof, the third circumferential groove 268*c* in the valve spool 30 is laterally aligned with the third fluid inlet and outlet ports 260*c* and 262*c* of the valve unit 20, providing communication between the fluid supply passageway 264 and the fluid feed conduit 24*c* leading to the third weft shooting nozzle 12*c* of the weft inserting unit 10. When the valve spool 30 is in the third axial position thereof, the first fluid inlet and outlet ports 260*a* and 262*a* and the second fluid inlet and outlet ports 260*b* and 262*b* of the valve unit 20 are closed by the first and second circumferential lands 266*a* and 266*b*, respectively, of the valve spool 30 so that the passageways in the fluid feed conduits 24*a* and 24*b* leading to the first and second weft shooting nozzles 12*a* and 12*b*, respectively, of the weft inserting unit 10 are isolated from the fluid supply passageway 264. When fluid under pressure is fed to the fluid supply passageway 264 of the fluid distributor valve unit 20 thus conditioned, the pressurized fluid is passed through the third fluid inlet port 260*c*, the third circumferential groove 268*c* in the valve spool 30 and the third fluid outlet port 262*c* to the fluid feed conduit 24*c* and by way of the conduit 24*c* to the third weft shooting nozzle 12*c* of the weft inserting unit 10. Upon ejection of a jet stream of fluid from the nozzle 12*c* thus effected, the main weft retaining unit 52 is actuated to raise the movable weft retaining elements 282*a*, 282*b* and 282*c* over the respectively associated stationary weft retaining elements 280*a*, 280*b* and 280*c* so that the weft yarn W*c* is passed through the main and auxiliary weft retaining units 52 and 54 and is inserted into the weaving shed by the fluid being ejected from the nozzle 12*c*.

When the weft yarn W*a* is selected in the cycle of operation immediately subsequent to a cycle of operation in which the weft yarn W*c* has been selected, the cam shaft 70 supporting the first and second inner cams 92 and 94 is driven to turn about its center axis from the second rotational position to the first rotational position thereof in the direction of the arrow b and, simultaneously, the cam shaft 70' supporting the third and fourth inner cams 100 and 102 is driven to turn about its center axis from the first rotational position to the second rotational position in the direction of the arrow b', as shown in FIG. 4A. In this instance, there is a transient condition in which both of the cam follower rollers 124 and 126 on the second inner lever **118*b* are concurrently confronted by the respective small-diameter cam lobe portions 94*a* and 100*a* of the second and third inner cams 94 and 100 on the cam shafts 70 and 70'**, respectively. Such a transient condition is brought about also when the weft yarn W*c* is selected in the cycle of operation immediately subsequent to a cycle of operation in which the weft yarn W*a* has been selected. Immediately prior to such a transient condition, one of the cams 94 and 100 turns about the center axis of the shaft 70 or 70' in a direction having its small-diameter cam lobe portion **94*a* or 100*a* contacted by the associated one of the cam follower rollers 204 and 204' on the lever 198 before the cam lobe portion 94*a* or 100*a* is brought into contact with the associated one of the cam follower rollers 124 and 126. When one of the cams 94 and 100 is thus turning through an angular position having its small-diameter cam lobe portion 94*a* or 100*a* contacted by the cam follower roller 204 or 204', respectively, the other of the cams 94 and 100 is turning through an angular position having its small-diameter portion 100*a* or 94*a* remaining in contact with the other of the cam follower rollers 204 and 204' on the lever 198. Both of the cam follower rollers 204 and 204' thus held in rolling contact with the respective small-diameter cam lobe portions 94*a* and 100*a* of the second and third inner cams 94 and 100 on the cam shafts 70 and 70', respectively, the lever 198 supporting the cam follower rollers 204 and 204' is held in an angular position closest to the center axes of the cam shafts 70 and 70' and has its extension 214 axially aligned with the bolt 218 on the extension 212 of the second inner lever 118*b*. When the cam follower rollers 124 and 126 on the lever 118*b* are thereafter confronted by the respective small-diameter cam lobe portions 94*a* and 100*a* of the cams 94 and 100, respectively, the bolt 218 on the lever 118*b* is brought into abutting engagement at its leading end with the end face of the extension 214 of the lever 198 by the force of the tension spring 136*b* acting on the lever 118*b*, as shown in FIG. 4A. The second inner lever 118*b* is in this fashion prevented from being moved into the angular position causing the second pressing roller 40*b* to contact the associated length measuring roller 34*b*** during the above mentioned transient condition in which the weft yarn W*a* or W*c* is selected after the weft yarn W*c* or W*a*, respectively, has been selected. As the cams 94 and 100 are further turned about the center axes of the cam shafts 70 and 70', respectively, one of the cams 94 and 100 has its large-diameter cam lobe portion **94*b* or 100*b* contacted by the associated one of the cam follower rollers 124 and 126 on the lever 118*b* and thereafter by the associated one of the cam follower rollers 204 and 204' on the lever 198 so that the extension 214 of the lever 198 is disengaged from the bolt 218 on the lever 118*b*** upon lapse of the above mentioned transient condition. During a cycle of operation in which the weft yarn W*b* is selected after the weft yarn W*a* or W*c* has been selected, one of the cams 94 and 100 remains in an angular position having its small-diameter cam lobe portion **94*a* or 100*a* contacted by the associated one of the cam follower rollers 124 and 126 on the lever 118*b* and its large-diameter cam lobe portion 94*b* or 100*b* contacted by the associated one of the cam follower rollers 204 and 204' on the lever 198, as shown in FIG. 4B. The lever 198 is therefore maintained in an angular position having its extension moved out of alignment with the bolt 218 on the lever 118*b*, which is accordingly allowed to turn into the angular position having the cam follower rollers 124 and 126 in contact with the respective small-diameter cam lobe portions 94*a* and 100*a* of the cams 94 and 100**.

What is claimed is:

1. An apparatus for selectively inserting weft yarns each into a shed of warp yarns in accordance with a predetermined weaving schedule in a shuttleless loom, comprising weft inserting means operative to insert a selected one of the weft yarns into the shed of warp yarns when actuated, conditioning means for producing conditions in which a selected weft yarn is to be inserted into the shed, at least two cam shafts axially aligned with each other and rotatable independently of each other in both directions about the respective center axes of the shafts in accordance with said weaving schedule, cams rotatable with and arranged axially of each of said cam shafts, levers rockable about an axis of rotation substantially parallel with the center axes of said cam shafts and each engageable with at least one of the cams on said cam shafts, the levers being driven to rock about said axis of rotation selectively depending upon the respective rotational positions of the cam shafts about said center axes, and mechanical linkage means operatively intervening between said levers and said conditioning means for enabling the conditioning means to produce said conditions depending upon the angular position of at least one of said levers about said axis of rotation.

2. An apparatus as set forth in claim 1, in which said cams include at least two cams mounted on said cam shafts, respectively, and each having first and second cam lobe portions substantially semicircular about the center axis of each of the cam shafts, the respective first cam lobe portions of the two cams being substantially equal in diameter and the second cam lobe portion of one of the two cams being larger in diameter than the second cam lobe portion of the other, said levers including at least two levers engageable with said two cams and rockable together with each other about said axis of rotation, each of said two levers having at least three different angular positions about said axis of rotation depending upon the respective angular positions of said two cams about the center axes of said cam shafts.

3. An apparatus as set forth in claim 1, in which said cams include at least four cams consisting of first, second, third and fourth cams each having small-diameter and large-diameter cam lobe portions substantially semicircular about the center axis of each of said cam shaft, the first and second cams being mounted in diametrically opposite relationship to each other on one of said cam shafts and the third and fourth cams being mounted in diametrically opposite relationship to each other on the other of said cam shafts, said levers including at least three levers consisting of first, second and third levers rockable independently of each other about said axis of rotation, the first and third levers being engageable with said first and fourth cams, respectively, and the second lever being engageable with said second and third cams, each of the three levers having at least two different angular positions about said axis of rotation depending upon the angular position of each of said first and fourth cams or the respective angular positions of said second and third cams.

4. An apparatus as set forth in claim 1, in which said cams comprise at least four cams consisting of first, second, third and fourth cams each having small-diameter and large-diameter cam lobe portions substantially semicircular about the center axis of the cam shifts, the first and second cams being mounted in diametrically opposite relationship to each other on one of said cam shafts and the third and fourth cams being mounted in diametrically opposite relationship to each other on the other of the cam shafts, and at least two cams each having small-diameter and large-diameter cam lobe portions substantially semicircular about the center axis of each of said cam shafts, each of the two cams being mounted on each of said cam shafts and being in diametrically opposite relationship to one of the other cams on the shaft, said levers comprising at least three levers rockable independently of each other about said axis of rotation, the first and third levers being engageable with said first and fourth cams, respectively, and the second lever being engageable with the second and third cams each of the three levers having at least two different angular positions about said axis of rotation depending upon the angular position of each of said first and fourth cams or the angular positions of said second and third cams, and at least two levers engageable with said two cams and rockable together with each other about said axis of rotation, each of said two levers having at least three different angular positions about said axis of rotation depending upon the respective angular positions of said two cams about the center axes of said cam shafts.

5. An apparatus as set forth in claim 3 or 4, in which said four cams are substantially similarly shaped and equally sized.

6. An apparatus as set forth in claim 1, 2, 3 or 4, in which said predetermined schedule is stored in and supplied to said cams from a dobby mechanism.

* * * * *